US012433327B2

(12) United States Patent
Baur et al.

(10) Patent No.: US 12,433,327 B2
(45) Date of Patent: Oct. 7, 2025

(54) AEROSOL-GENERATING ARTICLE HAVING A PLURALITY OF AIR INGRESS ZONES

(71) Applicant: Philip Morris Products S.A., Neuchatel (CH)

(72) Inventors: Guillaume Bastien Baur, Genolier (CH); Daniele Sanna, Marin-Epagnier (CH); Jerome Uthurry, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 354 days.

(21) Appl. No.: 17/905,734

(22) PCT Filed: Mar. 12, 2021

(86) PCT No.: PCT/EP2021/056410
§ 371 (c)(1),
(2) Date: Sep. 6, 2022

(87) PCT Pub. No.: WO2021/180962
PCT Pub. Date: Sep. 16, 2021

(65) Prior Publication Data

US 2023/0114313 A1 Apr. 13, 2023

(30) Foreign Application Priority Data

Mar. 12, 2020 (EP) ..... 20162842

(51) Int. Cl.
*A24D 1/20* (2020.01)
*A24D 3/04* (2006.01)
(Continued)

(52) U.S. Cl.
CPC ..... *A24D 1/20* (2020.01); *A24D 3/043* (2013.01); *A24D 3/17* (2020.01); *A24F 40/485* (2020.01); *A24F 40/20* (2020.01); *A24F 40/46* (2020.01)

(58) Field of Classification Search
None
See application file for complete search history.

(56) References Cited

U.S. PATENT DOCUMENTS 2,389,104 A * 11/1945 Bauer ..... A24D 1/008 131/360
5,125,421 A * 6/1992 Mitchell ..... A24D 1/02 131/365
(Continued)

FOREIGN PATENT DOCUMENTS

CA 2265185 A1 * 2/1998 ..... A24C 5/40
EP 0 924 997 B1 5/2001
(Continued)

OTHER PUBLICATIONS

Russian Notice of Allowance issued Jun. 25, 2024 in Russian Patent Application No. 2022126433/03, 8 pages.
(Continued)

*Primary Examiner* — Linda L Gray
(74) *Attorney, Agent, or Firm* — Oblon, McClelland, Maier &Neustadt, L.L.P.

(57) ABSTRACT

An aerosol-generating article for producing an aerosol upon heating is provided, the article including: a rod of aerosol-forming substrate; and a filter positioned downstream of the rod, in which the rod and the filter are assembled within a wrapper, the article further including first and second air ingress zones located on the wrapper, the first and the second air ingress zones each being configured to allow an ingress of air into an interior of the article, the first air ingress zone including a substantially porous portion of the wrapper, the
(Continued)

substantially porous portion having a porosity of at least 3000 Coresta Units, and a level of air ingress into the interior of the article through the first zone is greater than a level of air ingress into the interior of article through the second zone. An aerosol-generating system including the aerosol-generating article and an aerosol-generating device is also provided.

17 Claims, 3 Drawing Sheets

(51) Int. Cl.

| | |
|---|---|
| ***A24D 3/17*** | (2020.01) |
| ***A24F 40/20*** | (2020.01) |
| ***A24F 40/46*** | (2020.01) |
| ***A24F 40/485*** | (2020.01) |

(56) References Cited

U.S. PATENT DOCUMENTS

| | | | | |
|---|---|---|---|---|
| 5,388,594 | A | 2/1995 | Counts et al. | |
| 5,464,028 | A * | 11/1995 | Takeda | A24D 3/043 131/339 |
| 6,443,161 | B1 | 9/2002 | Kaczmarek et al. | |
| 6,553,999 | B1 | 4/2003 | Cardone et al. | |
| 2004/0089314 | A1* | 5/2004 | Felter | A24F 40/51 131/194 |
| 2004/0200488 | A1 | 10/2004 | Felter et al. | |
| 2005/0172976 | A1 | 8/2005 | Newman et al. | |
| 2009/0293894 | A1 | 12/2009 | Cecchetto et al. | |
| 2011/0155151 | A1 | 6/2011 | Newman et al. | |
| 2020/0345075 | A1 | 11/2020 | Hepworth | |

FOREIGN PATENT DOCUMENTS

| | | | |
|---|---|---|---|
| JP | 2006-505281 | A | 2/2006 |
| JP | 2008-518614 | A | 6/2008 |
| JP | 2017-516472 | A | 6/2017 |
| RU | 2 600 911 | C2 | 10/2016 |
| RU | 2 620 946 | C2 | 5/2017 |
| RU | 2 649 257 | C2 | 3/2018 |
| RU | 2 668 859 | C2 | 10/2018 |
| WO | WO 00/33675 | A1 | 6/2000 |
| WO | WO 2012/164009 | A2 | 12/2012 |
| WO | WO 2014/132045 | A2 | 9/2014 |
| WO | WO 2015/052652 | A1 | 4/2015 |
| WO | WO 2015/082649 | A1 | 6/2015 |
| WO | WO 2015/082652 | A1 | 6/2015 |
| WO | WO 2017/198838 | A1 | 11/2017 |
| WO | WO 2019/096983 | A1 | 5/2019 |
| WO | WO 2019/106040 | A1 | 6/2019 |
| WO | WO 2019/224366 | A1 | 11/2019 |
| WO | WO 2020/009420 | A1 | 1/2020 |
| WO | WO 2020/025729 | A1 | 2/2020 |

OTHER PUBLICATIONS

International Search Report mailed on Jun. 11, 2021 in PCT/EP2021/056410 filed on Mar. 12, 2021 (5 pages).

Written Opinion mailed on Jun. 11, 2021 in PCT/EP2021/056410 filed on Mar. 12, 2021 (7 pages).

Office Action mailed Apr. 1, 2025, issued in corresponding Japanese Patent Application No. 2022-554191 (with English translation).

* cited by examiner

AEROSOL-GENERATING ARTICLE HAVING A PLURALITY OF AIR INGRESS ZONES

The present invention relates to an aerosol-generating article for producing aerosol upon heating. An aerosol-generating system comprising the aerosol-generating article and an aerosol-generating device is also described in the present specification.

Aerosol-generating articles in which an aerosol-forming substrate, such as a tobacco-containing substrate, is heated rather than combusted, are known in the art. Typically in such heated aerosol-generating articles, an aerosol is generated by the transfer of heat from a heat source to a physically separate aerosol-forming substrate or material, which may be located in contact with, within, around, or downstream of the heat source. During use of the aerosol-generating article, volatile compounds are released from the aerosol-forming substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-forming substrate of a heated aerosol-generating article.

Typically, an aerosol-generating article is specifically adapted for use in conjunction with a particular aerosol-generating device or an aerosol-generating device is specifically adapted for use in conjunction with a particular aerosol-generating article. In particular, it may be required that certain aerosol-generating articles are not to be used with a particular aerosol-generating device. This may be because certain articles are suitable to be heated by the heating element of the particular aerosol-generating device, as such a device may overheat certain aerosol-generating articles or not heat other aerosol-generating articles.

Therefore, it would be desirable to provide an aerosol-generating article that is adapted to be used in an aerosol-generating system in which the usage of an incompatible aerosol-generating article with an aerosol-generating device is prevented.

In the present specification, there is provided an aerosol-generating article for producing an aerosol upon heating. The aerosol-generating article comprises a rod of aerosol-forming substrate and a filter positioned downstream of the rod of aerosol-forming substrate. The rod of aerosol-forming substrate and the filter are assembled within a wrapper. The aerosol-generating article comprises first and second air ingress zones located on the wrapper. The first and second air ingress zones are each configured to allow the ingress of air into the interior of the aerosol-generating article. The level of air ingress into the interior of the aerosol-generating article through the first air ingress zone is configured to be greater than the level of air ingress into the interior of aerosol-generating article through the second air ingress zone.

In the present specification, there is provided an aerosol-generating article for producing an aerosol upon heating. The aerosol-generating article may comprise a rod of aerosol-forming substrate. The aerosol-generating article may comprise a filter positioned downstream of the rod of aerosol-forming substrate. The rod of aerosol-forming substrate and the filter may be assembled within a wrapper. The aerosol-generating article may be comprises first and second air ingress zones located on the wrapper. The first and second air ingress zones may each be configured to allow the ingress of air into the interior of the aerosol-generating article. The level of air ingress into the interior of the aerosol-generating article through the first air ingress zone may be configured to be greater than the level of air ingress into the interior of aerosol-generating article through the second air ingress zone.

In the present specification, a downstream section may refer to the one or more components located downstream of the rod of aerosol-forming substrate. A filter may be a downstream section. The filter may form part of the downstream section. The downstream section may comprise a filter.

In the present specification, there is provided an aerosol-generating article for producing an aerosol upon heating. The aerosol-generating article may comprise a rod of aerosol-forming substrate. The aerosol-generating article may comprise a downstream section positioned downstream of the rod of aerosol-forming substrate. The rod of aerosol-forming substrate and the downstream section may be assembled within a wrapper. The aerosol-generating article may be comprises first and second air ingress zones located on the wrapper. The first and second air ingress zones may each be configured to allow the ingress of air into the interior of the aerosol-generating article. The level of air ingress into the interior of the aerosol-generating article through the first air ingress zone may be configured to be greater than the level of air ingress into the interior of aerosol-generating article through the second air ingress zone.

The aerosol-generating article may comprise an aerosol former. The aerosol-forming substrate may have an aerosol former content of greater than about 10 percent on a dry weight basis.

The aerosol-generating article may be configured to be used with a particular aerosol-generating device to form an aerosol-generating system. The present disclosure also relates to such an aerosol-generating system. As used herein, the term "aerosol-generating device" refers to a device comprising a heating element that interacts with the aerosol-generating substrate of the aerosol-generating article to generate an aerosol.

The aerosol-generating device of the aerosol-generating system may have a distal end and a mouth end. The aerosol-generating device may comprise a housing. The housing may define a device cavity for removably receiving the aerosol-generating article at the mouth end of the device. The aerosol-generating device may comprise a heater for heating the aerosol-forming substrate when the aerosol-generating article is received within the device cavity. The aerosol-generating device may comprise an air-flow channel extending between a channel inlet and a channel outlet. The air-flow channel may be configured to establish a fluid communication between the interior of the device cavity and the exterior of the aerosol-generating device. The aerosol-generating system, or device, may be configured so that, when the aerosol-generating article is received within the device cavity, fluid communication between the interior of the aerosol-generating article and the exterior of the aerosol-generating device may be established by a fluid communication being established between the first air ingress zone of the aerosol-generating article received within the device cavity and the air-flow channel of the aerosol-generating device.

In order for an aerosol-generating article of the present invention to be consumed and generate aerosol within an aerosol-generating device of an aerosol-generating system, fluid communication between the interior of the aerosol-generating article and the exterior of the aerosol-generating device must be established. During consumption, a user may draw on the aerosol-generating article such that aerosol being generating within the aerosol-generating article can be experienced and consumed by the user. Through such drawing action, air may flow from the exterior of the aerosol-generating device, through the aerosol-generating device, and into and through the aerosol-generating article in order to transport generated aerosol within the article to the mouth of the user.

By configuring the aerosol-generating system so that fluid communication between the interior of the aerosol-generating article and the exterior of the aerosol-generating device is established by a fluid communication being established between the first air ingress zone of the aerosol-generating article received within the device cavity and the air-flow channel of the aerosol-generating device, it is ensured that compatible aerosol-generating articles are used with the aerosol-generating device. In order to be used in the aerosol-generating system of the present invention, compatible aerosol-generating articles are required to have a first air ingress zone configured in such a manner that a fluid communication is established between the first air ingress zone of the aerosol-generating article when received within the device cavity and the air-flow channel of the aerosol-generating device. Further, compatible aerosol-generating devices are required to have an air-flow channel to be configured in such a manner that it establishes a fluid communication with the first air ingress zone of an aerosol-generating article received within the device.

Fluid communication between the interior of the aerosol-generating article and the exterior of the aerosol-generating device may be established by an air-flow channel outlet of the aerosol-generating device overlying, or overlapping, the first air ingress zone of the aerosol-generating article received within the device cavity. Thus, compatible aerosol-generating articles are required to have a first air ingress zone configured in such a manner that an air-flow channel outlet of the aerosol-generating device overlies, or overlaps, the first air ingress zone of the aerosol-generating article when received within the device cavity. Further, compatible aerosol-generating devices are required to have an air-flow channel to be configured in such a manner that an outlet overlies, or overlaps, the first air ingress zone of an aerosol-generating article when received within the device.

If an incompatible aerosol-generating article is used with an aerosol-generating device of the presently disclosed aerosol-generating system, then the user may not be able to use the aerosol-generating system and may not be able to consume, or at least fully experience, the incompatible aerosol-generating article. Further, if a compatible aerosol-generating article is used with a different aerosol-generating device not belonging to the aerosol-generating system of the present disclosure, then the user may also not be able to use the aerosol-generating system and may not be able to consume, or at least fully experience, the compatible aerosol-generating article. This is because the fluid communication between the interior of the aerosol-generating article and the exterior of the aerosol-generating device may not be suitably or fully established if an alignment of the air-flow channel outlet of the aerosol-generating device and the first air ingress zone of the aerosol-generating article does not occur.

The fluid communication between the exterior of the aerosol-generating device and the interior of the aerosol-generating article may be established by a partial or complete overlap or alignment between the outlet of the air-flow channel of the device and the first air ingress zone of the article.

The fluid communication between the exterior of the aerosol-generating device and the interior of the aerosol-generating article may be established by a partial or complete overlap or alignment between the air-flow channel of the device and the first air ingress zone of the article.

By providing a first and second air ingress zone and by configuring the level of air ingress into the interior of the aerosol-generating article through the first air ingress zone to be greater than the level of air ingress into the interior of aerosol-generating article through the second air ingress zone, the aerosol-generating article of the present invention can provide both a primary air intake zone at the first air ingress zone and a ventilation zone at the second air ingress zone. During use in a compatible aerosol-generating device, the first air ingress zone may allow most of the air to enter the aerosol-generating article while the second air ingress zone may provide ventilation to the aerosol flow being produced in order to cool the flow and improve a consumer's experience.

As used herein, the term "longitudinal" refers to the direction corresponding to the main longitudinal axis of the aerosol-generating article or device, which extends between the upstream and downstream ends of the aerosol-generating article or aerosol-generating device.

As used herein, the terms "upstream" and "downstream" describe the relative positions of elements, or portions of elements, of the aerosol-generating article or device in relation to the direction in which the aerosol is transported through the aerosol-generating article during use.

The term "mouth end" refers to the portion of an element or component that is configured to be in, or in the vicinity of, the mouth of a user during normal use of the element or component. The mouth end of a component may also correspond to a downstream end of the same component. For example, the mouth end of the aerosol-generating article may also be the downstream end of the article. The mouth end of the aerosol-generating article or device is configured to be placed in, or in the vicinity of, the mouth of a consumer during normal use. The mouth end of the aerosol-generating device may also be referred to as the proximal end of the aerosol-generating device.

During use, air is primarily drawn through the aerosol-generating article in the longitudinal direction. Outside of the device, air may be drawn through the article via the upstream end.

The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article or device with reference to the longitudinal direction.

The device cavity may be referred to as the heating chamber of the aerosol-generating device. The device cavity may extend between a distal end and a mouth, or proximal, end. The distal end of the device cavity may be a closed end and the mouth, or proximal, end of the device cavity may be an open end. An aerosol-generating article may be inserted into the device cavity, or heating chamber, via the open end of the device cavity. The device cavity may be cylindrical in shape so as to conform to the same shape of an aerosol-generating article.

The expression "received within" may refer to the fact that a component or element is fully or partially received within another component or element. For example, the expression "aerosol-generating article is received within the device cavity" refers to the aerosol-generating article being fully or partially received within the device cavity of the aerosol-generating article. When the aerosol-generating article is received within the device cavity, the aerosol-generating article may abut the distal end of the device cavity. When the aerosol-generating article is received within the device cavity, the aerosol-generating article may be in substantial proximity to the distal end of the device cavity. The distal end of the device cavity may be defined by an end-wall.

The length of the device cavity may be between about 10 mm and about 50 mm. The length of the device cavity may be between about 20 mm and about 40 mm. The length of the device cavity may be between about 25 mm and about 30 mm. The length of the device cavity may be the same as or greater than the length of the rod of the aerosol-forming substrate.

A diameter of the device cavity may be between about 4 mm and about 50 mm. A diameter of the device cavity may be between about 4 mm and about 30 mm. A diameter of the device cavity may be between about 5 mm and about 15 mm. A diameter of the device cavity may be between about 6 mm and about 12 mm. A diameter of the device cavity may be between about 7 mm and about 10 mm. A diameter of the device cavity may be between about 7 mm and about 8 mm.

A diameter of the device cavity may be the same as or greater than a diameter of the aerosol-generating article. A diameter of the device cavity may be the same as a diameter of the aerosol-generating article in order to establish a tight fit with the aerosol-generating article.

The device cavity may be configured to establish a tight fit with an aerosol-generating article received within the device cavity. Tight fit may refer to a snug fit. The aerosol-generating device may comprise a peripheral wall. Such a peripheral wall may define the device cavity, or heating chamber. The peripheral wall defining the device cavity may be configured to engage with an aerosol-generating article received within the device cavity in a tight fit manner, so that there is substantially no gap or empty space between the peripheral wall defining the device cavity and the aerosol-generating article when received within the device.

Such a tight fit may establish an airtight fit or configuration between the device cavity and an aerosol-generating article received therein. Such an airtight configuration may mean that air can only be drawn into the interior of the aerosol-generating article through the alignment or overlap of the air-flow channel outlet and the first air ingress zone. With such an airtight configuration, there would be substantially no gap or empty space between the peripheral wall defining the device cavity and the aerosol-generating article for air to flow through. Therefore, when an incompatible aerosol-generating article is used with the aerosol-generating device, such an alignment may not occur and therefore air may not be drawn through the incompatible aerosol-generating article.

The tight fit with an aerosol-generating article may be established along the entire length of the device cavity or along a portion of the length of the device cavity. The tight fit may be established at a position downstream of the first air ingress zone of the aerosol-generating article. The portion of the peripheral wall that is configured to establish such a tight fit may be referred to as the sealing portion of the peripheral wall. Such a tight fit may be established when the air-flow channel is defined within the thickness of the peripheral wall of the aerosol-generating device. The sealing portion of the peripheral wall may be defined along the whole length of the device cavity.

When the air-flow channel is defined on the inner surface of the peripheral wall of the device housing, a portion of the peripheral wall between the air-flow channel and the distal end of the device cavity may define the sealing portion of the peripheral wall. This will ensure that air may not flow beyond the air-flow channel towards the upstream end of the aerosol-generating article. The portion of the peripheral wall between the air-flow channel and the distal end of the device cavity may form an airtight configuration with an upstream portion of the aerosol-generating article, when received within the device.

The sealing portion of the peripheral wall may be configured to establish an airtight fit with a portion of the aerosol-generating article at a position downstream of the first air ingress zone of the aerosol-generating article. The sealing portion of the peripheral wall may be configured to establish an airtight fit with a portion of the aerosol-generating article at a position downstream of a second air ingress zone of the aerosol-generating article.

The diameter of the device cavity may vary along the longitudinal direction of the aerosol-generating device. The diameter of the device cavity may decrease from the distal end of the device cavity to the sealing portion of the peripheral wall.

The diameter of the device cavity may increase from the sealing portion of the peripheral wall in a direction towards the distal end of the device cavity. The diameter of the device cavity between the distal end of the device cavity and the sealing portion of the peripheral wall may be greater than the diameter of the rest of the device cavity. The diameter of the device cavity may increase in a direction away from the sealing portion of the peripheral wall and away from the mouth end of the device.

By providing a portion of the device cavity with a greater diameter or greater diameters than the rest of the device cavity, the device cavity may define gap or chamber around (surrounding) an upstream portion of the aerosol-generating article when received within the device. In such embodiments, alignment or overlap between the first air ingress zone and the first outlet of the air-flow channel of the device may not be necessary to ensure fluid communication between the exterior of the device and the interior of the article. Air flow will still need to be admitted into the article via the first air ingress zone. Air flowing into the device cavity via the first outlet of the air-flow channel may flow into such gap or chamber and then be drawn into the article via the first air ingress zone. Such gap or chamber may provide a cushion of air around said upstream portion of the article, which could either be heated by the heater of the device or act as a cushion of cooling air surrounding the article.

The aerosol-generating device may comprise a peripheral wall defining the device cavity and the aerosol-generating device may comprise a circumferential protrusion extending from the peripheral wall into the device cavity, the circumferential protrusion being configured to establish an airtight fit with a portion of the aerosol-generating article, when received within the aerosol-generating device, at a position downstream of the first air ingress zone of the aerosol-generating article.

The diameter of the device cavity may be greater than the diameter of the aerosol-generating article and the inner diameter of the circumferential protrusion may be the same as the diameter of the aerosol-generating article such that a tight fit is established between the article and the circumferential protrusion once the article is received within the aerosol-generating device. The inner diameter of the circumferential protrusion may even be smaller than the diameter of the aerosol-generating article. This may ensure that an airtight fit is more reliably established.

By establishing an airtight fit with the aerosol-generating article downstream of the first air ingress zone, it is further ensured that air can only enter the interior of the aerosol-generating article through the alignment of the air-flow channel outlet and the first air ingress zone. This may be achieved either by the sealing portion of the peripheral wall or the circumferential protrusion, both of which are described above.

When the aerosol-generating article is received within the device cavity, the upstream end of the aerosol-generating article may be blocked such that air is substantially prevented from entering the aerosol-generating article through its upstream end. However, when the aerosol-generating article is not received within the aerosol-generating device, air may flow through the aerosol-generating article through its upstream end. When the article is received or inserted into the device, the upstream end of the aerosol-generating article may about the distal end of the device cavity such that air may no longer be able to flow through the upstream end of the article. As such, the air flowing through the air-flow channel may only be able to be drawn through the article via the first air ingress zone. The upstream end of the aerosol-generating article may be defined by the upstream end of the rod of aerosol-forming substrate.

The aerosol-generating device may comprise an air-flow channel extending between a channel inlet and a channel outlet. The air-flow channel may be configured to establish a fluid communication between the interior of the device cavity and the exterior of the aerosol-generating device. The air-flow channel of the aerosol-generating device may be defined within the housing of the aerosol-generating device to enable fluid communication between the interior of the device cavity and the exterior of the aerosol-generating device. When an aerosol-generating article is received within the device cavity, the air-flow channel may be configured to provide air flow into the article in order to deliver generated aerosol to a user drawing from the mouth end of the article.

The air-flow channel of the aerosol-generating device may be defined within, or by, the peripheral wall of the housing of the aerosol-generating device. In other words, the air-flow channel of the aerosol-generating device may be defined within the thickness of the peripheral wall or by the inner surface of the peripheral wall, or a combination of both. The air-flow channel may partially be defined by the inner surface of the peripheral wall and may be partially defined within the thickness of the peripheral wall. The inner surface of the peripheral wall defines a peripheral boundary of the device cavity.

The air-flow channel of the aerosol-generating device may extend from an inlet located at the mouth end, or proximal end, of the aerosol-generating device to an outlet located away from mouth end of the device. The air-flow channel may extend along a direction parallel to the longitudinal axis of the aerosol-generating device. The outlet of the air-flow channel is configured such that, when a compatible aerosol-generating article is received within the device cavity, the outlet overlies the first air ingress zone of the article.

The air-flow channel may be provided with more than one outlet, one for each air ingress zone provided in an article configured to be used with the aerosol-generating device. For example, if an aerosol-generating article comprises a first air ingress zone and a second air ingress zone, then the air-flow channel of a corresponding aerosol-generating device may have at least one first outlet for overlying the first air ingress zone and at least one second outlet for overlying the second air ingress zone when the aerosol-generating article is fully received within the aerosol-generating device. Thus, the aerosol-generating system may be configured so that, when the aerosol-generating article is received within the device cavity, fluid communication between the interior of the aerosol-generating article and the exterior of the aerosol-generating device is established by a fluid communication being established between the first and second air ingress zones of the aerosol-generating article received within the device cavity and the air-flow channel of the aerosol-generating device.

When the air-flow channel is defined within the peripheral wall of the device, the air-flow channel may comprise a first portion extending in the axial direction of device from a channel inlet and a second portion extending in the transverse, or radial, direction from the end of the first portion to a channel outlet. As a result, the air-flow channel may comprise a bend or elbow in order to connect the inlet and outlet of the air-flow channel. If the air-flow channel comprises more than one outlet along its length, the air-flow channel may comprise further channel portions extending in a transverse direction from the first portion to each of the further outlets. Where an air-flow channel comprises a single outlet, the air-flow channel may comprise an L-shaped bend or elbow.

When the air-flow channel is defined by the inner surface of the peripheral wall, a length of the air-flow channel may be exposed directly to the device cavity, that is, a longitudinal side of the air-flow channel may be open to the device cavity. The thickness of the portion of the peripheral wall defining the air-flow channel may be less than the thickness of the rest of the peripheral wall. The diameter of the portion of the peripheral wall defining the air-flow channel may be greater than the diameter of the rest of the peripheral wall. In such embodiments, the air-flow channel may be annular in shape such that the air-flow channel circumscribes the device cavity and an aerosol-generating article received within the device cavity.

In embodiments where the air-flow channel is defined by the inner surface of the peripheral wall of the housing, the entire length of the air-flow channel may be exposed or open to the device cavity and thus to an aerosol-generating article received within the device. In such embodiments, in order to establish a fluid communication between the exterior of the aerosol-generating device and the interior of the aerosol-generating article, the air-flow channel is configured to overlie all air ingress zones of a compatible aerosol-generating article. In such embodiments, an outlet of the air-flow channel may be considered the open side of the air-flow channel; that is, the side of the air-flow channel exposed or opened to the device cavity.

The length of the air-flow channel may be less than the length of the device cavity. The length of the air-flow channel refers to the longitudinal or axial distance by which the air-flow channel extends.

The air-flow channel may be configured such that a first outlet of the air-flow channel is arranged to align with or overlie the first air ingress zone of an aerosol-generating article received within the device cavity. The air-flow channel may extend from a first inlet located at the mouth end of the housing of the aerosol-generating device to the first outlet. The first, or any, outlet of the air-flow channel may be provided between the distal end and mouth end of the device cavity.

The first outlet may be located at least about 2 mm away from the distal end of the device cavity. The first outlet may be located at least about 3 mm away from the distal end of the device cavity. The first outlet may be located at least about 5 mm away from the distal end of the device cavity. The first outlet may be located at least about 7 mm away from the distal end of the device cavity.

A distance of the first outlet from the distal end of the device cavity and a distance of the first air ingress zone, when the article is received within the device cavity, from the distal end of the device cavity may be similar or the same. A distance of a further outlet of the air-flow channel from the distal end of the device cavity and a distance of a further air ingress zone, when the article is received within the device cavity, from the distal end of the device cavity may be similar or the same. A distance of a distal end of the air-flow channel from the distal end of the device cavity and a distance of an air ingress zone, when the article is received within the device cavity, from the distal end of the device cavity may be similar or the same.

The first outlet may be located no more than about 25 mm away from the distal end of the device cavity. The first outlet may be located between about 3 mm and about 20 mm away from the distal end of the device cavity. The first outlet may be located between about 5 mm and about 18 mm away from the distal end of the device cavity. The first outlet may be located between about 7 mm and about 16 mm away from the distal end of the device cavity. The air-flow channel may not extend beyond the distal end of the device cavity.

The length of the air-flow channel may be about 23 mm. The length of the air-flow channel may be between about 3 mm and about 100 mm. The length of the air-flow channel may be between about 8 mm and about 70 mm. The length of the air-flow channel may be between about 10 mm and about 50 mm. The length of the air-flow channel may be between about 12 mm and about 40 mm. The length of the air-flow channel may be between about 12 mm and about 40 mm. The length of the air-flow channel may be between about 15 mm and about 30 mm. The length of the air-flow channel may be between about 20 mm and about 25 mm.

If a compatible aerosol-generating article comprises a first air ingress zone located downstream of the rod of aerosol-forming substrate, the length of the air-flow channel may be between about 8 mm and about 25 mm. The length of the air-flow channel may be between about 10 mm and about 15 mm. The length of the air-flow channel may be between about 11 mm and about 13 mm.

The diameter of the air-flow channel may be between about 0.1 mm and about 5 mm. The diameter of the air-flow channel may be about 0.5 mm and about 4 mm. The diameter of the air-flow channel may be about 1 mm and about 3 mm. The diameter of the air-flow channel may be about 1.5 mm and about 2.5 mm. The diameters of the air-flow channel and its outlets and inlets may be the same or different.

The 'length' of the air-flow channel may refer to how much the air-flow channel extends in the longitudinal direction.

There may be a plurality of air-flow channels provided in the aerosol-generating device, each having at least one inlet and at least one outlet. Such a plurality of air-flow channels may be evenly and circumferentially distributed around the device cavity.

A, or each, air-flow channel may comprise a single inlet and multiple outlets. In such embodiments, there may be one outlet corresponding to each air ingress zone provided on an aerosol-generating article configured to be received within the aerosol-generating device.

As discussed above, an aerosol-generating article in accordance with the present invention comprises a rod of aerosol-forming substrate and filter or downstream section located downstream of the rod of aerosol-forming substrate.

The aerosol-generating article may further comprise an upstream section at a location upstream of the rod of aerosol-generating substrate. The upstream section may comprise one or more upstream elements. In some embodiments, the upstream section may comprise an upstream element arranged immediately upstream of the aerosol-generating element. The upstream element may extend from an upstream end of the aerosol-generating substrate to the upstream end of the aerosol-generating article. The upstream element may abut the upstream end of the aerosol-generating article. The upstream element may be referred to as an upstream section. The aerosol-generating article may comprise an air inlet at the upstream end of the aerosol-generating article. Where the aerosol-generating article comprises an upstream element, the air inlet may be provided through the upstream element. The air entering through the air inlet may pass into the aerosol-generating substrate in order to generate the mainstream aerosol.

The porosity or permeability of the upstream section may advantageously be varied in order to provide a desirable overall resistance to draw of the aerosol-generating article.

In some embodiments, the upstream section may be formed from a material that is impermeable to air. In such embodiments, the aerosol-generating article may be configured such that air flows into the rod of aerosol-generating substrate through suitable ventilation means provided in a wrapper.

The upstream section may be made of any material suitable for use in an aerosol-generating article. For example, the upstream element may comprise a plug of material. Suitable materials for forming the upstream section include filter materials, ceramic, polymer material, cellulose acetate, cardboard, zeolite or aerosol-generating substrate. Preferably, the upstream section comprises a plug comprising cellulose acetate.

Where the upstream section comprises a plug of material, the downstream end of the plug of material may about the upstream end of the aerosol-generating substrate. For example, the upstream section may comprise a plug comprising cellulose acetate abutting the upstream end of the aerosol-generating substrate. This may advantageously help retain the aerosol-generating substrate in place.

Where the upstream section comprises a plug of material, the downstream end of the plug of material may be spaced apart from the upstream end of the aerosol-generating substrate. The upstream element may comprise a plug comprising fibrous filtration material.

The upstream section may have a length of at least about 1 millimetre. For example, the upstream section may have a length of at least about 2 millimetres, at least about 4 millimetres, or at least about 6 millimetres.

The upstream section may have a length of no more than about 15 millimetres. For example, the upstream section may have a length of no more than about 12 millimetres, no more than about 10 millimetres, or no more than about 8 millimetres.

The upstream section may have a length of between about 1 millimetre and about 15 millimetres. For example, the upstream section may have a length of between about 2 millimetres and about 12 millimetres, between about 4 millimetres and about 10 millimetres, or between about 6 millimetres and about 8 millimetres.

The upstream section or element may comprise a hollow tubular segment.

The filter or downstream section may comprise a mouthpiece segment comprising a plug of filtration material, and a hollow tubular segment at a location between the rod of aerosol-forming substrate and the mouthpiece segment. All three elements may be longitudinally aligned. The rod of aerosol-forming substrate may comprise at least an aerosol former. The hollow tubular segment may be a support segment or a cooling segment. A hollow tubular segment may be positioned or located immediately downstream of the aerosol-forming substrate.

The filter or downstream section may comprise a mouthpiece segment comprising a plug of filtration material, and an aerosol-cooling segment (or element) at a location between the rod of aerosol-forming substrate and the mouthpiece segment. All three elements may be longitudinally aligned.

The mouthpiece segment may comprise a hollow tubular segment. The mouthpiece segment may be a hollow tubular segment. The mouthpiece segment may be a plug of filtration material.

As used herein, an 'aerosol-cooling element' may refer to a component of an aerosol-generating article located downstream of the aerosol-forming substrate such that, in use, an aerosol formed by volatile compounds released from the aerosol-forming substrate passes through and is cooled by the aerosol cooling element before being inhaled by a user. An aerosol cooling element has a large surface area, but causes a low pressure drop. The aerosol-cooling element may act to cool the temperature of a stream of aerosol drawn through the element by means of thermal transfer. Components of the aerosol will interact with the aerosol-cooling element and loose thermal energy.

The aerosol-cooling element may comprise a sheet material selected from the group comprising a metallic foil, a polymeric sheet, and a substantially non-porous paper or cardboard. In some embodiments, the aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil.

After consumption, aerosol-generating articles are typically disposed of. It may be advantageous for the elements forming the aerosol-generating article to be biodegradable. Thus, it may be advantageous for the aerosol-cooling element to be formed from a biodegradable material, for example a non-porous paper or a biodegradable polymer such as polylactic acid or a grade of Mater-Bi® (a commercially available family of starch based copolyesters). In some embodiments, the entire aerosol-generating article is biodegradable or compostable.

In some embodiments, an aerosol-generating article in accordance with the invention may comprise an additional support element (or support segment) arranged between, and in longitudinal alignment with, the rod of aerosol-forming substrate and, the hollow tubular segment or the aerosol-cooling segment (or element). In more detail, the support element (or support segment) may be provided immediately downstream of the rod and immediately upstream of the hollow tubular segment or the aerosol-cooling element. The additional support element or segment may be tubular.

The wrapper of the aerosol-generating article may comprise an air-impermeable material. The wrapper of the aerosol-generating article may comprise an air-impervious material. By providing the aerosol-generating article with an air-impermeable or air-impervious material, when the upstream end of the aerosol-generating article is blocked upon insertion into the device cavity, or heating chamber, of the aerosol-generating device, it is ensured that air has to be drawn through the first air ingress zone in order for air to enter the aerosol-generating article. In other words, it is ensured that the first air ingress zone may define the primary, and only, air intake portion of the article through which air can be drawn through into the article.

The expression "air-impervious material" or "air-impermeable material" is used throughout this specification to mean a material substantially not allowing the passage of fluids, particularly air and smoke, through interstices or pores in the material. If, for example, the wrapper is formed of a material impervious to air and aerosol particles, air and aerosol particles drawn through the article cannot flow across the material of the wrapper. By contrast, the term "porous" is used herein to refer to a material that provides a plurality of pores or openings that allow the passage of air through the material.

By providing a wrapper with an air-impermeable material, air may only access the interior of the aerosol-generating article via the first air ingress zone provided in the wrapper when the article is received within the aerosol-generating device.

The first air ingress zone may be located at a (first) position along the aerosol-generating article. The first air ingress zone of the aerosol-generating article may be located along the rod of aerosol-forming substrate. The first air ingress zone may be located around the rod of aerosol-forming substrate. The first air ingress zone of the aerosol-generating article may be located at position along the rod of aerosol-forming substrate.

The first air ingress zone may be located at a position downstream of the rod of the aerosol-forming substrate. The first air ingress zone may be located at least 1 mm downstream of, or from, the rod of the aerosol-forming substrate.

The first air ingress zone of the aerosol-generating article may be located along the hollow tubular segment. The first air ingress zone may be located around the hollow tubular segment. The first air ingress zone of the aerosol-generating article may be located at position along the hollow tubular segment.

The first air ingress zone of the aerosol-generating article may be located along the support segment. The first air ingress zone may be located around the support segment. The first air ingress zone of the aerosol-generating article may be located at position along the support segment. The support segment may be a hollow support segment.

The aerosol-generating article may extend between an upstream end and a downstream end. The downstream end of the article may coincide with the downstream end of the rod of aerosol-forming substrate. In other words, the downstream end of the rod of aerosol-forming substrate may define a downstream end of the aerosol-generating article.

The first air ingress zone may be located at least about 2 mm downstream of the upstream end of the rod of aerosol-forming substrate. The first air ingress zone may be located at least about 3 mm downstream of the upstream end of the rod of aerosol-forming substrate. The first air ingress zone may be located at least about 4 mm downstream of the upstream end of the rod of aerosol-forming substrate. The first air ingress zone may be located at least about 5 mm downstream of the upstream end of the rod of aerosol-forming substrate. The first air ingress zone may be located at least about 6 mm downstream of the upstream end of the rod of aerosol-forming substrate. The first air ingress zone may be located at least about 7 mm downstream of the upstream end of the rod of aerosol-forming substrate. The first air ingress zone may be located at least about 8 mm downstream of the upstream end of the rod of aerosol-forming substrate. The first air ingress zone may be located at least about 9 mm downstream of the upstream end of the rod of aerosol-forming substrate. The first air ingress zone may be located at least about 10 mm downstream of the upstream end of the rod of aerosol-forming substrate. The first air ingress zone may be located at least about 12 mm downstream of the upstream end of the rod of aerosol-forming substrate.

The first air ingress zone may be located about 20 mm or less downstream of the upstream end of the rod of aerosol-forming substrate. The first air ingress zone may be located about 15 mm or less downstream of the upstream end of the rod of aerosol-forming substrate. The first air ingress zone may be located about 14 mm or less downstream of the upstream end of the rod of aerosol-forming substrate. The first air ingress zone may be located about 13 mm or less downstream of the upstream end of the rod of aerosol-forming substrate. The first air ingress zone may be located about 12 mm or less downstream of the upstream end of the rod of aerosol-forming substrate. The first air ingress zone may be located about 10 mm or less downstream of the upstream end of the rod of aerosol-forming substrate. The first air ingress zone may be located about 9 mm or less downstream of the upstream end of the rod of aerosol-forming substrate. The first air ingress zone may be located about 8 mm or less downstream of the upstream end of the rod of aerosol-forming substrate. The first air ingress zone may be located about 6 mm or less downstream of the upstream end of the rod of aerosol-forming substrate. The first air ingress zone may be located about 5 mm or less downstream of the upstream end of the rod of aerosol-forming substrate.

The first air ingress zone may be located between about 2 mm and about 20 mm downstream of the upstream end of the rod of aerosol-forming substrate. The first air ingress zone may be located between about 3 mm and about 15 mm downstream of the upstream end of the rod of aerosol-forming substrate. The first air ingress zone may be located between about 4 mm and about 12 mm downstream of the upstream end of the rod of aerosol-forming substrate.

The first air ingress zone may be located between about 2 mm and about 15 mm downstream of the upstream end of the rod of aerosol-forming substrate. The first air ingress zone may be located between about 3 mm and about 12 mm downstream of the upstream end of the rod of aerosol-forming substrate. The first air ingress zone may be located between about 5 mm and about 10 mm downstream of the upstream end of the rod of aerosol-forming substrate.

The first air ingress zone may be located between about 2 mm and about 12 mm downstream of the upstream end of the rod of aerosol-forming substrate. The first air ingress zone may be located between about 3 mm and about 10 mm downstream of the upstream end of the rod of aerosol-forming substrate. The first air ingress zone may be located between about 5 mm and about 8 mm downstream of the upstream end of the rod of aerosol-forming substrate.

The first air ingress zone may be located between about 2 mm and about 10 mm downstream of the upstream end of the rod of aerosol-forming substrate. The first air ingress zone may be located between about 3 mm and about 9 mm downstream of the upstream end of the rod of aerosol-forming substrate. The first air ingress zone may be located between about 5 mm and about 8 mm downstream of the upstream end of the rod of aerosol-forming substrate.

The first air ingress zone may be located between about 2 mm and about 8 mm downstream of the upstream end of the rod of aerosol-forming substrate. The first air ingress zone may be located between about 2 mm and about 6 mm downstream of the upstream end of the rod of aerosol-forming substrate. The first air ingress zone may be located between about 2 mm and about 5 mm downstream of the upstream end of the rod of aerosol-forming substrate.

The first air ingress zone may be located between about 10 mm and about 20 mm downstream of the upstream end of the rod of aerosol-forming substrate. The first air ingress zone may be located between about 12 mm and about 15 mm downstream of the upstream end of the rod of aerosol-forming substrate.

The first air ingress zone may be located along the upstream half of the rod of aerosol-forming substrate. By positioning the first air ingress zone along the upstream half of the rod of aerosol-forming substrate, air being drawn through the first air ingress zone may be drawn through a substantial length of the rod of aerosol-forming substrate in order to optimise aerosol generation and efficiently use the aerosol-forming substrate.

The first air ingress zone may be located along the downstream half of the rod of aerosol-forming substrate. The first air ingress zone may be located along the upstream half of the hollow tubular segment. The first air ingress zone may be located along the upstream half of the support segment. The first air ingress zone may be located along the downstream half of the hollow tubular segment. The first air ingress zone may be located along the downstream half of the support segment.

Throughout this specification, where it is stated that the air ingress zone is or may be located along a certain component of the aerosol-generating article, this refers to the fact that the air ingress zone is located on a portion of the wrapper that overlies such a component of the aerosol-generating article. For example, if the air ingress zone is located along the rod of aerosol-forming substrate, this refers to the fact that the air ingress zone is located on a portion of the wrapper that overlies the rod of aerosol-forming substrate.

The term "upstream half" refers to the region or portion of an element between the upstream end of the element and the midpoint of the element. The term "downstream half" refers to the region or portion of an element between the downstream end of the element and the midpoint of the element.

The aerosol-generating article may be provided with additional air ingress zones to provide additional functionality to the first air ingress zone. The aerosol-generating article may comprise a second air ingress zone located on the wrapper. Such a second air ingress zone may be configured to provide ventilation to the aerosol-generating article during use within the device as a ventilation zone, while the first air ingress zone serves as an air intake zone of the article.

Further, air ingress zones may be provided so as to provide further ventilation to the article during normal, and compatible, use.

The second air ingress zone may be located at a (second) position along the aerosol-generating article. The second air ingress zone may be located on the wrapper, at a position, downstream of the first air ingress zone. The second air ingress zone may be provided at location along a same component of the aerosol-generating article as the first air ingress zone. For example, if the first air ingress zone is provided along the rod of aerosol-forming substrate, the second air ingress zone may be provided along the rod of aerosol-forming substrate at a position downstream of the first air ingress zone.

The second air ingress zone may be located downstream of the rod of aerosol-forming substrate. The second air ingress zone may be located downstream of the downstream end of the rod of aerosol-forming substrate. The second air ingress zone may be located along the filter or downstream section of the aerosol-generating article. The second air ingress zone may be located along the hollow tubular segment. The second air ingress zone may be located along the support segment.

The second air ingress zone may be located at least about 1 mm downstream of the rod of aerosol-forming substrate. That is, the second air ingress zone may be located at least 1 mm downstream of the downstream end of the rod of aerosol-forming substrate. The second air ingress zone may be located at least about 2 mm downstream of the rod of aerosol-forming substrate. The second air ingress zone may be located at least about 3 mm downstream of the rod of aerosol-forming substrate.

The second air ingress zone may be located about 8 mm or less downstream of the rod of aerosol-forming substrate. The second air ingress zone may be located about 7 mm or less downstream of the rod of aerosol-forming substrate. The second air ingress zone may be located about 6 mm or less downstream of the rod of aerosol-forming substrate.

The second air ingress zone may be located between about 1 mm and about 8 mm downstream of the rod of aerosol-forming substrate. The second air ingress zone may be located between about 2 mm and about 7 mm downstream of the rod of aerosol-forming substrate. The second air ingress zone may be located between about 2 mm and about 6 mm downstream of the rod of aerosol-forming substrate. The second air ingress zone may be located between about 3 mm and about 6 mm downstream of the rod of aerosol-forming substrate.

The second air ingress zone may be located at least about 1 mm downstream of the upstream end of the hollow tubular segment. The second air ingress zone may be located at least about 2 mm downstream of the upstream end of the hollow tubular segment. The second air ingress zone may be located at least about 3 mm downstream of the upstream end of the hollow tubular segment.

The second air ingress zone may be located about 8 mm or less downstream of the upstream end of the hollow tubular segment. The second air ingress zone may be located about 7 mm or less downstream of the upstream end of the hollow tubular segment. The second air ingress zone may be located about 6 mm or less downstream of the upstream end of the hollow tubular segment.

The second air ingress zone may be located between about 1 mm and about 8 mm downstream of the upstream end of the hollow tubular segment. The second air ingress zone may be located between about 2 mm and about 7 mm downstream of the upstream end of the hollow tubular segment. The second air ingress zone may be located between about 2 mm and about 6 mm downstream of the upstream end of the hollow tubular segment. The second air ingress zone may be located between about 3 mm and about 6 mm downstream of the upstream end of the hollow tubular segment.

The second air ingress zone may be located at least about 1 mm downstream of the upstream end of the support segment. The second air ingress zone may be located at least about 2 mm downstream of the upstream end of the support segment. The second air ingress zone may be located at least about 3 mm downstream of the upstream end of the support segment.

The second air ingress zone may be located about 8 mm or less downstream of the upstream end of the support segment. The second air ingress zone may be located about 7 mm or less downstream of the upstream end of the support segment. The second air ingress zone may be located about 6 mm or less downstream of the upstream end of the support segment.

The second air ingress zone may be located between about 1 mm and about 8 mm downstream of the upstream end of the support segment. The second air ingress zone may be located between about 2 mm and about 7 mm downstream of the upstream end of the support segment. The second air ingress zone may be located between about 2 mm and about 6 mm downstream of the upstream end of the support segment. The second air ingress zone may be located between about 3 mm and about 6 mm downstream of the upstream end of the support segment.

As discussed above, the second air ingress zone may be located along the rod of aerosol-forming substrate. The second air ingress zone may be located at least about 3.5 mm downstream of the upstream end of the rod of aerosol-forming substrate. The second air ingress zone may be located at least about 4 mm downstream of the upstream end of the rod of aerosol-forming substrate. The second air ingress zone may be located at least about 6.5 mm downstream of the upstream end of the rod of aerosol-forming substrate.

The second air ingress zone may be located about 20 mm or less downstream of the upstream end of the rod of aerosol-forming substrate. The second air ingress zone may be located about 16 mm or less downstream of the upstream end of the rod of aerosol-forming substrate. The second air ingress zone may be located about 12 mm or less downstream of the upstream end of the rod of aerosol-forming substrate.

The second air ingress zone may be located between about 3.5 mm and about 20 mm downstream of the upstream end of the rod of aerosol-forming substrate. The second air ingress zone may be located between about 4 mm and about 16 mm downstream of the upstream end of the rod of aerosol-forming substrate. The second air ingress zone may be located between about 6.5 mm and about 12 mm downstream of the upstream end of the rod of aerosol-forming substrate.

The second air ingress zone may be located at least about 1.5 mm downstream of the first air ingress zone. The second air ingress zone may be located at least about 2 mm downstream of the first air ingress zone. The second air ingress zone may be located at least about 3 mm downstream of the first air ingress zone.

The second air ingress zone may be located at least about 10 mm downstream of the first air ingress zone. The second air ingress zone may be located at least about 12 mm downstream of the first air ingress zone. In such embodiments, the second air ingress zone may be located downstream of the rod of aerosol-forming substrate.

The second air ingress zone may be located about 20 mm or less downstream of the first air ingress zone. The second air ingress zone may be located about 18 mm or less downstream of the first air ingress zone. The second air ingress zone may be located about 16 mm or less downstream of the first air ingress zone.

The second air ingress zone may be located between about 1.5 mm and about 20 mm downstream of the first air ingress zone. The second air ingress zone may be located between about 2 mm and about 18 mm downstream of the first air ingress zone. The second air ingress zone may be located between about 3 mm and about 16 mm downstream of the first air ingress zone.

The second air ingress zone may be located along the upstream half of the rod of aerosol-forming substrate. The second air ingress zone may be located along the downstream half of the rod of aerosol-forming substrate. The second air ingress zone may be located along the upstream half of the hollow tubular segment. The second air ingress zone may be located along the upstream half of the support segment. The second air ingress zone may be located along the downstream half of the hollow tubular segment. The second air ingress zone may be located along the downstream half of the support segment.

An air ingress zone may comprise one or more rows of apertures, or perforations, extending through the wrapper of the aerosol-generating article. The apertures, or perforations, of an air ingress zone may extend through the filter or downstream section of the aerosol-generating article. The apertures, or perforations, of an air ingress zone may extend through the peripheral wall of the hollow tubular segment of the article. The apertures, or perforations, of the air ingress zone may extend through the peripheral wall of the support segment of the article, particularly if the support segment is hollow.

An air ingress zone may comprise only one row of apertures or perforations. A row of apertures, or perforations, may comprise between 8 to 30 apertures or perforations. A row of apertures, or perforations, may comprise between 10 to 20 apertures or perforations. The air ingress zone may circumscribe the aerosol-generating article. The air ingress zone may circumscribe the rod of aerosol-forming substrate. The air ingress zone may circumscribe the hollow tubular segment. The air ingress zone may circumscribe the support segment.

The perforations of an air ingress zone may be of uniform size. As an alternative, the perforations may vary in size. By varying the number and size of the perforations, it is possible to adjust the amount of external air admitted into the hollow tubular segment when the consumer draws on the mouthpiece of the aerosol-generating article during use. As such, it is advantageously possible to adjust the ventilation or air intake level of the aerosol-generating article. Preferably, the perforations are round.

The air ingress perforations can be formed using any suitable technique, for example by laser technology, mechanical perforation of the hollow tubular segment or support segment as part of the aerosol-generating article or pre-perforation of the hollow tubular segment or support segment before it is combined with the other elements to form the aerosol-generating article. Preferably, the perforations are formed by online laser perforation.

In addition, the inventors have found that in aerosol-generating articles in accordance with the invention the cooling and diluting effect caused by the admission of ventilation air at the location along the conduit defined by the hollow tubular segment described above has a surprising reducing effect on the generation and delivery of phenol-containing species.

The air ingress or ventilation zone may comprise one or more rows of perforations formed through the peripheral wall of the hollow tubular segment. As discussed above, the second air ingress zone may be a ventilation zone. Preferably, the ventilation zone comprises only one row of perforations. This is understood to be advantageous in that, by concentrating the cooling effect brought about by ventilation over a short portion of the cavity defined by the hollow tube segment, it may be possible to further enhance aerosol nucleation. This is because a faster and more drastic cooling of the stream of volatilised species is expected to particularly favour the formation of new nuclei of aerosol particles.

Preferably, the one or more rows of perforations are arranged circumferentially around the wall of the hollow tube. Where the ventilation zone comprises two or more rows of perforations formed through the peripheral wall of the hollow tubular segment, the rows are longitudinally spaced apart from one another along the hollow tubular segment.

The radius of the air ingress perforations, or apertures, may be at least about 0.05 mm. The radius of the air ingress perforations, or apertures, may be at least about 0.06 mm. The radius of the air ingress perforations, or apertures, may be at least about 0.1 mm. The radius of the air ingress perforations may be between about 0.06 mm and about 0.1 mm.

An equivalent diameter of at least one of the ventilation or air ingress perforations is preferably at least about 100 micrometres. Preferably, an equivalent diameter of at least one of the ventilation perforations is at least about 150 micrometres. Even more preferably, an equivalent diameter of at least one of the ventilation perforations is at least about 200 micrometres. In addition, or as an alternative, an equivalent diameter of at least one of the ventilation perforations is preferably less than about 500 micrometres. More preferably, an equivalent diameter of at least one of the ventilation perforations is less than about 450 micrometres. Even more preferably, an equivalent diameter of at least one of the ventilation perforations is less than about 400 micrometres. The term "equivalent diameter" is used herein to denote the diameter of a circle having the same surface area of a cross-section of the ventilation perforation. A cross-section of the ventilation perforations may have any suitable shape. However, circular ventilation perforations are preferred.

The ventilation or air ingress perforations may be of uniform size. As an alternative, the ventilation perforations may vary in size. By varying the number and size of the ventilation perforations, it is possible to adjust the amount of external air admitted into the hollow tubular segment when the consumer draws on the mouthpiece of the aerosol-generating article during use. As such, it is advantageously possible to adjust the ventilation level of the aerosol-generating article.

An air ingress zone may comprise a substantially porous portion of the wrapper of the aerosol-generating article. Such a porous portion may be defined in the air-impervious or air-impermeable wrapper of the aerosol-generating article or may be defined by a different material forming part of the wrapper of the aerosol-generating article. Such a porous portion may be defined by a porous pattern defined in the wrapper. Such a porous portion may define the first or second air ingress zone. As such, the first or second air ingress zone may have the porosity characteristics of such a porous portion.

Such a porous portion of the wrapper may have a relatively high porosity, in relation to the rest of the wrapper of the aerosol-generating article. The porosity of such a porous portion may be at least about 3000 Coresta Units (CU). The porosity of such a porous portion may be at least about 5000 Coresta Units (CU). The porosity of such a porous portion may be less than about 25000 Coresta Units (CU). The porosity of such a porous portion may be less than about 20000 Coresta Units (CU). The porosity of such a porous portion may be between about 3000 CU and about 25000 CU. The porosity of such a porous portion may be between about 5000 CU and about 20000 CU.

The width of an air ingress zone (a first, second or any air ingress zone) may be at least about 1 mm. The width of an air ingress zone may be at least about 3 mm. The width of an air ingress zone may be at least about 5 mm. The 'width' of an air ingress zone refers to the sizing of an air ingress zone in the axial or longitudinal direction of the aerosol-generating article. This, the 'width' of an air ingress zone may be referred to as a 'length' of the air ingress zone.

The width of the first air ingress zone may be greater than the width of the second air ingress zone. This enables the first air ingress zone to serve its function as the primary air intake of the aerosol-generating article when received within a compatible aerosol-generating device, while the second or subsequent air ingress zone may serve as secondary air intake zones or ventilation zones.

Such a relatively wide air ingress zone may be formed from a porous portion of the wrapper having a relatively high porosity (as described above), a plurality of lines of perforations or a line of relatively wide perforations.

By providing a wide air ingress zone, such as the first air ingress zone, there will be more surface area of the first air ingress to overlap or to align with an outlet of the air-flow channel of the aerosol-generating device. This would therefore reliably ensure that a fluid communication between the exterior of the aerosol-generating device and the interior of the aerosol-generating article received within the device is established so that a consumer can suitably consume the article. Having a relatively wide air ingress zone may account for any manufacturing imprecision of the air ingress zone that may affect the alignment of an outlet of the air-flow channel of the device and the air ingress zone.

An air ingress zone may fully or partially circumscribe the aerosol-generating article. An air ingress zone may be located around the aerosol-generating article.

The aerosol-generating article may comprise a first air ingress zone and a second air ingress zone located along the rod of aerosol-forming substrate. The aerosol-generating article may comprise a first air ingress zone located along the rod of aerosol-forming substrate and a second air ingress zone located downstream of the rod of aerosol-forming substrate. The aerosol-generating article may comprise a first air ingress zone located along the rod of aerosol-forming substrate and a second air ingress zone located along a hollow tubular segment. The aerosol-generating article may comprise a first air ingress zone located along the rod of aerosol-forming substrate and a second air ingress zone located along a support segment.

Each air ingress zone may provide or allow a certain level of air ingress into the interior of the aerosol-generating article. A level of air ingress may refer to an amount of fluid that is allowed to enter through an air ingress zone in order to enter into the interior of the aerosol-generating article. The level of air ingress may be expressed in terms of the volume of air, in cubic millimetres, that may enter via an air ingress zone during a period of time, expressed in seconds. The level of air ingress may be expressed as a mass flow rate, in grams or kilograms per second, or a volume flow rate, millilitres or litres per second.

The level of air ingress into the interior of the aerosol-generating article through the first air ingress zone may be configured to be greater than the level of air ingress into the interior of aerosol-generating article through the second air ingress zone. This is to ensure that a suitable amount of air flows through the first air ingress zone during use, when the aerosol-generating article is received within an aerosol-generating device, in order to serve as a primary air intake zone for the article, while the second air ingress zone may provide ventilation to the article.

The level of air ingress through an air ingress zone may be defined as a volume flow rate. The level of air ingress, that is, the volume flow rate, into the interior of the aerosol-generating article through the first air ingress zone may be at least about 10 percent greater than the level of air ingress (volume flow rate) into the interior of the aerosol-generating article through the second air ingress zone. The level of air ingress, that is, the volume flow rate, into the interior of the aerosol-generating article through the first air ingress zone may be at least about 20 percent greater than the level of air ingress (volume flow rate) into the interior of the aerosol-generating article through the second air ingress zone. The level of air ingress, that is, the volume flow rate, into the interior of the aerosol-generating article through the first air ingress zone may be at least about 30 percent greater than the level of air ingress (volume flow rate) into the interior of the aerosol-generating article through the second air ingress zone.

The level of air ingress, that is, the volume flow rate, into the interior of the aerosol-generating article through the first air ingress zone may be less than about 300 percent greater than the level of air ingress (volume flow rate) into the interior of the aerosol-generating article through the second air ingress zone. The level of air ingress, that is, the volume flow rate, into the interior of the aerosol-generating article through the first air ingress zone may be less than about 200 percent greater than the level of air ingress (volume flow rate) into the interior of the aerosol-generating article through the second air ingress zone. The level of air ingress, that is, the volume flow rate, into the interior of the aerosol-generating article through the first air ingress zone may be less than about 100 percent greater than the level of air ingress (volume flow rate) into the interior of the aerosol-generating article through the second air ingress zone. The level of air ingress, that is, the volume flow rate, into the interior of the aerosol-generating article through the first air ingress zone may be less than about 90 percent greater than the level of air ingress (volume flow rate) into the interior of the aerosol-generating article through the second air ingress zone. The level of air ingress, that is, the volume flow rate, into the interior of the aerosol-generating article through the first air ingress zone may be less than about 75 percent greater than the level of air ingress (volume flow rate) into the interior of the aerosol-generating article through the second air ingress zone. The level of air ingress, that is, the volume flow rate, into the interior of the aerosol-generating article through the first air ingress zone may be less than about 60 percent greater than the level of air ingress (volume flow rate) into the interior of the aerosol-generating article through the second air ingress zone.

From a certain volume of air entering the aerosol-generating device through the air-flow channel, or plurality of air-flow channels, during a period of time, a first proportion of such a volume of air intake may enter into the interior of the aerosol-generating article through the first air ingress zone and a second proportion of such a volume of air intake may enter into the interior of the aerosol-generating article through the second air ingress zone. For example, during a period of time T a volume V of air may enter into the aerosol-generating device, then a first proportion of V, expressed as a percentage of V, may enter into the interior of the aerosol-generating article through the first air ingress zone and a second proportion of V may enter into the interior of the aerosol-generating article through the second air ingress zone.

In relation to a total volume of air intake entering the aerosol-generating device during a period of time, at least about 50 percent of such total volume may enter into the interior of the aerosol-generating article through the first air ingress zone. In relation to a total volume of air intake entering the aerosol-generating device during a period of time, at least about 55 percent of such total volume may enter into the interior of the aerosol-generating article through the first air ingress zone. In relation to a total volume of air intake entering the aerosol-generating device during a period of time, at least about 60 percent of such total volume may enter into the interior of the aerosol-generating article through the first air ingress zone. In relation to a total volume of air intake entering the aerosol-generating device during a period of time, at least about 70 percent of such total volume may enter into the interior of the aerosol-generating article through the first air ingress zone. In relation to a total volume of air intake entering the aerosol-generating device during a period of time, at least about 75 percent of such total volume may enter into the interior of the aerosol-generating article through the first air ingress zone.

In relation to a total volume of air intake entering the aerosol-generating device during a period of time, about 50 percent or less of such total volume may enter into the interior of the aerosol-generating article through the second air ingress zone. In relation to a total volume of air intake entering the aerosol-generating device during a period of time, about 45 percent or less of such total volume may enter into the interior of the aerosol-generating article through the second air ingress zone. In relation to a total volume of air intake entering the aerosol-generating device during a period of time, about 40 percent or less of such total volume may enter into the interior of the aerosol-generating article through the second air ingress zone. In relation to a total volume of air intake entering the aerosol-generating device during a period of time, about 30 percent or less of such total volume may enter into the interior of the aerosol-generating article through the second air ingress zone. In relation to a total volume of air intake entering the aerosol-generating device during a period of time, about 25 percent or less of such total volume may enter into the interior of the aerosol-generating article through the second air ingress zone.

In relation to a total volume of air intake entering the aerosol-generating device during a period of time, about 50 percent of such total volume may enter into the interior of the aerosol-generating article through the first air ingress zone and about 50 percent of such total volume may enter into the interior of the aerosol-generating article through the second air ingress zone.

In relation to a total volume of air intake entering the aerosol-generating device during a period of time, about 55 percent of such total volume may enter into the interior of the aerosol-generating article through the first air ingress zone and 45 percent of such total volume may enter into the interior of the aerosol-generating article through the second air ingress zone.

In relation to a total volume of air intake entering the aerosol-generating device during a period of time, about 60 percent of such total volume may enter into the interior of the aerosol-generating article through the first air ingress zone and about 40 percent of such total volume may enter into the interior of the aerosol-generating article through the second air ingress zone.

In relation to a total volume of air intake entering the aerosol-generating device during a period of time, about 70 percent of such total volume may enter into the interior of the aerosol-generating article through the first air ingress zone and about 30 percent of such total volume may enter into the interior of the aerosol-generating article through the second air ingress zone.

In relation to a total volume of air intake entering the aerosol-generating device during a period of time, about 75 percent of such total volume may enter into the interior of the aerosol-generating article through the first air ingress zone and about 25 percent of such total volume may enter into the interior of the aerosol-generating article through the second air ingress zone.

Similarly, a certain volume flow rate may flow through the air-flow channel, or plurality of air-flow channels, of the aerosol-generating device before the air exits the air-flow channel towards the aerosol-generating article. From such an intake volume flow rate (or air-flow channel volume flow rate existing in the air-flow channel prior to the outlets), a first proportion of such intake volume flow rate may flow through the first air ingress zone and a second proportion of such intake volume flow rate may flow through the second air ingress zone. For example, a volume flow rate VF may flow through the air-flow channel, then a first proportion of VF, expressed as a percentage of VF, may flow through the first air ingress zone and a second proportion of VF may flow through the second air ingress zone.

In relation to an intake volume flow rate flowing through the air-flow channel of the aerosol-generating device, at least about 50 percent of such intake volume flow rate may flow through the first air ingress zone. In relation to an intake volume flow rate flowing through the air-flow channel of the aerosol-generating device, at least about 55 percent of such intake volume flow rate may flow through the first air ingress zone. In relation to an intake volume flow rate flowing through the air-flow channel of the aerosol-generating device, at least about 60 percent of such intake volume flow rate may flow through the first air ingress zone. In relation to an intake volume flow rate flowing through the air-flow channel of the aerosol-generating device, at least about 70 percent of such intake volume flow rate may flow through the first air ingress zone. In relation to an intake volume flow rate flowing through the air-flow channel of the aerosol-generating device, at least about 75 percent of such intake volume flow rate may flow through the first air ingress zone.

In relation to an intake volume flow rate flowing through the air-flow channel of the aerosol-generating device, about 50 percent or less of such intake volume flow rate may flow through the second air ingress zone. In relation to an intake volume flow rate flowing through the air-flow channel of the aerosol-generating device, about 45 percent or less of such intake volume flow rate may flow through the second air ingress zone. In relation to an intake volume flow rate flowing through the air-flow channel of the aerosol-generating device, about 40 percent or less of such intake volume flow rate may flow through the second air ingress zone. In relation to an intake volume flow rate flowing through the air-flow channel of the aerosol-generating device, about 30 percent or less of such intake volume flow rate may flow through the second air ingress zone. In relation to an intake volume flow rate flowing through the air-flow channel of the aerosol-generating device, about 25 percent or less of such intake volume flow rate may flow through the second air ingress zone.

In relation to an intake volume flow rate flowing through the air-flow channel of the aerosol-generating device, about 50 percent of such intake volume flow rate may flow through the first air ingress zone and about 50 percent of such intake volume flow rate may flow through the second air ingress zone.

In relation to an intake volume flow rate flowing through the air-flow channel of the aerosol-generating device, about 55 percent of such intake volume flow rate may flow through the first air ingress zone and about 45 percent of such intake volume flow rate may flow through the second air ingress zone.

In relation to an intake volume flow rate flowing through the air-flow channel of the aerosol-generating device, about 60 percent of such intake volume flow rate may flow through the first air ingress zone and about 40 percent of such intake volume flow rate may flow through the second air ingress zone.

In relation to an intake volume flow rate flowing through the air-flow channel of the aerosol-generating device, about 70 percent of such intake volume flow rate may flow through the first air ingress zone and about 30 percent of such intake volume flow rate may flow through the second air ingress zone.

In relation to an intake volume flow rate flowing through the air-flow channel of the aerosol-generating device, about 75 percent of such intake volume flow rate may flow through the first air ingress zone and about 25 percent of such intake volume flow rate may flow through the second air ingress zone.

The term "ventilation level" may be used throughout the present specification to denote a volume ratio between the airflow admitted into the aerosol-generating article via an air ingress zone (air ingress airflow) and an airflow exiting the aerosol-generating article via the mouth end, or downstream end. The greater the ventilation level, the higher the dilution of the aerosol flow delivered to the consumer. The ventilation level is measured on the aerosol-generating article on its own—that is, without inserting the aerosol-generating article in a suitable aerosol-generating device adapted to heat the aerosol-forming substrate.

The ventilation level provided by a first air ingress zone may be measured by occluding all other air ingress zones, if present, and drawing air from the mouth end of the aerosol-generating article so that air may flow through the front end or upstream end of the aerosol-generating article and the first air ingress zone into the aerosol-generating article. The ventilation level provided by the first air ingress zone may be defined as the ratio between the flow rate of air (airflow) entering the aerosol-generating article through the first air ingress zone and the flow rate of air exiting the aerosol-generating article at the mouth end.

The ventilation level provided by a second air ingress zone may be measured by occluding all other air ingress zones, if present, and drawing air from the mouth end of the aerosol-generating article so that air may flow through the front end or upstream end of the aerosol-generating article and the second air ingress zone into the aerosol-generating article. The ventilation level provided by the second air ingress zone may be defined as the ratio between the flow rate of air (airflow) entering the aerosol-generating article through the second air ingress zone and the flow rate of air exiting the aerosol-generating article at the mouth end.

The total ventilation level of the aerosol-generating article may be measured by not occluding any of the air ingress zones present in the aerosol-generating article and drawing air from the mouth end of the aerosol-generating article so that air may flow through the front end or upstream end of the aerosol-generating article and the air ingress zones into the aerosol-generating article. The total ventilation level of the aerosol-generating article may be defined as the ratio between the sum of flow rates of air entering the aerosol-generating article through each of the air ingress zones and the flow rate of air exiting the aerosol-generating article at the mouth end.

The ventilation level provided to the aerosol-generating article by a first air ingress zone may be at least about 10 percent. The ventilation level provided by a first air ingress zone may be at least about 20 percent. The ventilation level provided by a first air ingress zone may be at least about 25 percent. The ventilation level provided by a first air ingress zone may be at least about 50 percent. The ventilation level provided by a first air ingress zone may be at least about 75 percent.

The ventilation level provided to the aerosol-generating article by a second air ingress zone may be at least about 10 percent. The ventilation level provided by a second air ingress zone may be at least about 20 percent. The ventilation level provided by a second air ingress zone may be at least about 25 percent. The ventilation level provided by a second air ingress zone may be at least about 50 percent. The ventilation level provided by a second air ingress zone may be at least about 75 percent.

The ventilation level provided by the first air ingress zone or by the second air ingress zone may be about 75 percent or less. The ventilation level provided by the first air ingress zone or by the second air ingress zone may be about 60 percent or less. The ventilation level provided by the first air ingress zone or by the second air ingress zone may be about 50 percent or less.

The ventilation level provided by the first air ingress zone or by the second air ingress zone may be between about 10 percent and about 75 percent. The ventilation level provided by the first air ingress zone or by the second air ingress zone may be between about 30 percent and about 60 percent.

The aerosol-generating article may typically have a total ventilation level of at least about 10 percent, preferably at least about 20 percent.

The aerosol-generating article may have a total ventilation level of at least about 20 percent or about 25 percent or about 30 percent. The aerosol-generating article may have a total ventilation level of at least about 35 percent. The aerosol-generating article may have a total ventilation level of less than about 60 percent. The aerosol-generating article may have a total ventilation level of less than about 50 percent or less than about 40 percent. The aerosol-generating article may have a total ventilation level between about 25 percent and about 60 percent.

The aerosol-generating article may have a total ventilation level from about 10 percent to about 90 percent. The aerosol-generating article may have a total ventilation level from about 20 percent to about 80 percent. The aerosol-generating article may have a total ventilation level from about 25 percent to about 60 percent. The aerosol-generating article may have a total ventilation level from about 30 percent to about 50 percent. The aerosol-generating article may have a total ventilation level from about 30 percent to about 40 percent.

The aerosol-generating article may have a total ventilation level from about 28 percent to about 42 percent. The aerosol-generating article may have a ventilation level of about 35 percent. The inventors have surprisingly found that the diluting effect on the aerosol—which can be assessed by measuring, in particular, the effect on the delivery of glycerin included in the aerosol-forming substrate as the aerosol former—is advantageously minimised when the ventilation level is between about 30 percent and about 50 percent. In particular, ventilation levels between about 35 percent and about 42 percent have been found to lead to particularly satisfactory values of glycerin delivery. At the same time, the extent of nucleation and, as a consequence, the delivery of nicotine and aerosol-former (for example, glycerol) are enhanced.

The first air ingress zone may serve as a first, or primary, air intake zone and the second air ingress zone may serve as a ventilation zone of the aerosol-generating article. This is because the first ingress zone will be configured to be the first point of intake of air when the aerosol-generating article is located within the device cavity and may be configured to admit the highest level of air compared to any other of the air ingress zone provided on the wrapper of the article.

The first air ingress zone will ensure compatibility between aerosol-generating article and aerosol-generating device, as described above, by defining the primary air intake zone of the article, while the second air ingress zone will provide ventilation to the aerosol-generating article during normal use, when the aerosol-generating article is received within the device. All air ingress zones may be located within the device cavity, or heating chamber, of the aerosol-generating device during normal use. This will prevent a user from inadvertently obscuring any of the air ingress zone during normal use with a hand or lips, which could negatively affect a user's experience as the article may not be as well ventilated.

There are benefits to providing ventilation to an aerosol-generating article during normal use. Without wishing to be bound by theory, it has been found that the temperature drop caused by the admission of cooler, external air into the hollow tubular segment via the ventilation zone may have an advantageous effect on the nucleation and growth of aerosol particles.

In this scenario, which may be further complicated by coalescence phenomena, the temperature and rate of cooling can play a critical role in determining how the system responds. In general, different cooling rates may lead to significantly different temporal behaviours as concerns the formation of the liquid phase (droplets), because the nucleation process is typically nonlinear. Without wishing to be bound by theory, it is hypothesised that cooling can cause a rapid increase in the number concentration of droplets, which is followed by a strong, short-lived increase in this growth (nucleation burst). This nucleation burst would appear to be more significant at lower temperatures. Further, it would appear that higher cooling rates may favour an earlier onset of nucleation. By contrast, a reduction of the cooling rate would appear to have a favourable effect on the final size that the aerosol droplets ultimately reach.

Therefore, the rapid cooling induced by the admission of external air into the hollow tubular segment via the ventilation zone can be favourably used to favour nucleation and growth of aerosol droplets. However, at the same time, the admission of external air into the hollow tubular segment has the immediate drawback of diluting the aerosol stream delivered to the consumer.

In addition, it has been found that in aerosol-generating articles in accordance with the invention the cooling and diluting effect caused by the admission of ventilation air at the location along the conduit defined by the hollow tubular segment described above has a surprising reducing effect on the generation and delivery of phenol-containing species.

This is understood to be advantageous in that, by concentrating the cooling effect brought about by ventilation over a short portion of the cavity defined by the hollow tubular segment, it may be possible to further enhance aerosol nucleation. This is because a faster and more drastic cooling of the stream of volatilised species from the aerosol-forming substrate is expected to particularly favour the formation of new nuclei of aerosol particles.

The rod of aerosol-forming substrate preferably has an external diameter that is approximately equal to the external diameter of the aerosol-generating article.

Preferably, the rod of aerosol-forming substrate has an external diameter of at least about 4 millimetres (mm). The rod of aerosol-forming substrate may have an external diameter of at least about 5 millimetres. The rod of aerosol-forming substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol-forming substrate has an external diameter of 7.2 millimetres, to within 10 percent.

The rod of aerosol-forming substrate may have a length of between about 5 millimetres and about 100 mm. Preferably, the rod of aerosol-forming substrate has a length of at least about 5 millimetres, more preferably at least about 7 millimetres. In addition, or as an alternative, the rod of aerosol-forming substrate preferably has a length of less than about 80 millimetres, more preferably less than about 65 millimetres, even more preferably less than about 50 millimetres. In particularly preferred embodiments, the rod of aerosol-forming substrate has a length of less than about 35 millimetres, more preferably less than 25 millimetres, even more preferably less than about 20 millimetres. In one embodiment, the rod of aerosol-forming substrate may have a length of about 10 millimetres. In a preferred embodiment, the rod of aerosol-forming substrate has a length of about 12 millimetres.

Preferably, the rod of aerosol-forming substrate has a substantially uniform cross-section along the length of the rod. Particularly preferably, the rod of aerosol-forming substrate has a substantially circular cross-section.

In preferred embodiments, the aerosol-forming substrate comprises one or more gathered sheets of homogenised tobacco material. The one or more sheets of homogenised tobacco material may be textured. As used herein, the term 'textured sheet' denotes a sheet that has been crimped, embossed, debossed, perforated or otherwise deformed. Textured sheets of homogenised tobacco material for use in the invention may comprise a plurality of spaced-apart indentations, protrusions, perforations or a combination thereof. The rod of aerosol-forming substrate may comprise a gathered crimped sheet of homogenised tobacco material circumscribed by a wrapper.

In certain preferred embodiments, the aerosol-forming substrate comprises homogenised plant material, preferably a homogenised tobacco material.

As used herein, the term "homogenised plant material" encompasses any plant material formed by the agglomeration of particles of plant. For example, sheets or webs of homogenised tobacco material for the aerosol-forming substrates of the present invention may be formed by agglomerating particles of tobacco material obtained by pulverising, grinding or comminuting plant material and optionally one or more of tobacco leaf lamina and tobacco leaf stems. The homogenised plant material may be produced by casting, extrusion, paper making processes or other any other suitable processes known in the art.

The homogenised plant material can be provided in any suitable form. For example, the homogenised plant material may be in the form of one or more sheets. As used herein with reference to the invention, the term "sheet" describes a laminar element having a width and length substantially greater than the thickness thereof.

Alternatively or in addition, the homogenised plant material may be in the form of a plurality of pellets or granules.

Alternatively or in addition, the homogenised plant material may be in the form of a plurality of strands, strips or shreds. As used herein, the term "strand" describes an elongate element of material having a length that is substantially greater than the width and thickness thereof. The term "strand" should be considered to encompass strips, shreds and any other homogenised plant material having a similar form. The strands of homogenised plant material may be formed from a sheet of homogenised plant material, for example by cutting or shredding, or by other methods, for example, by an extrusion method.

As used herein, the term 'crimped sheet' is intended to be synonymous with the term 'creped sheet' and denotes a sheet having a plurality of substantially parallel ridges or corrugations. Preferably, the crimped sheet of homogenised tobacco material has a plurality of ridges or corrugations substantially parallel to the cylindrical axis of the rod according to the invention. This advantageously facilitates gathering of the crimped sheet of homogenised tobacco material to form the rod. However, it will be appreciated that crimped sheets of homogenised tobacco material for use in the invention may alternatively or in addition have a plurality of substantially parallel ridges or corrugations disposed at an acute or obtuse angle to the cylindrical axis of the rod. In certain embodiments, sheets of homogenised tobacco material for use in the rod of the article of the invention may be substantially evenly textured over substantially their entire surface. For example, crimped sheets of homogenised tobacco material for use in the manufacture of a rod for use in an aerosol-generating article in accordance with the invention may comprise a plurality of substantially parallel ridges or corrugations that are substantially evenly spaced-apart across the width of the sheet.

Sheets or webs of homogenised tobacco material for use in the invention may have a tobacco content of at least about 40 percent by weight on a dry weight basis, more preferably of at least about 60 percent by weight on a dry weight basis, more preferably or at least about 70 percent by weight on a dry basis and most preferably at least about 90 percent by weight on a dry weight basis.

Sheets or webs of homogenised tobacco material for use in the aerosol-forming substrate may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-forming substrate may comprise other additives including, but not limited to, tobacco and non-tobacco fibres, aerosol-formers, humectants, plasticisers, flavourants, fillers, aqueous and non-aqueous solvents and combinations thereof.

The homogenised plant, or tobacco, material comprises tobacco particles, or material, in combination with non-tobacco plant flavour particles. The non-tobacco plant flavour particles may be selected from one or more of: ginger particles, rosemary particles, eucalyptus particles, clove particles and star anise particles.

Suitable extrinsic binders for inclusion in sheets or webs of homogenised tobacco material for use in the aerosol-forming substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets or webs of homogenised tobacco material for use in the aerosol-forming substrate are known in the art and include, but are not limited to: cellulose fibres; soft-wood fibres; hard-wood fibres; jute fibres and combinations thereof. Prior to inclusion in sheets of homogenised tobacco material for use in the aerosol-forming substrate, non-tobacco fibres may be treated by suitable processes known in the art including, but not limited to: mechanical pulping; refining; chemical pulping; bleaching; sulphate pulping; and combinations thereof.

In other embodiments of the present invention, the aerosol-forming substrate may comprise a gel composition that includes an alkaloid compound, or a cannabinoid compound, or both an alkaloid compound and a cannabinoid compound. The aerosol-forming substrate may comprise a gel composition that includes nicotine. The aerosol-forming substrate may comprise a gel composition that does not include nicotine.

Preferably, the gel composition comprises an alkaloid compound, or a cannabinoid compound, or both an alkaloid compound and a cannabinoid compound; an aerosol former; and at least one gelling agent. Preferably, the at least one gelling agent forms a solid medium and the glycerol is dispersed in the solid medium, with the alkaloid or cannabinoid dispersed in the glycerol. Preferably, the gel composition is a stable gel phase.

Advantageously, a stable gel composition comprising nicotine provides predictable composition form upon storage or transit from manufacture to the consumer. The stable gel composition comprising nicotine substantially maintains its shape. The stable gel composition comprising nicotine substantially does not release a liquid phase upon storage or transit from manufacture to the consumer. The stable gel composition comprising nicotine may provide for a simple consumable design. This consumable may not have to be designed to contain a liquid, thus a wider range of materials and container constructions may be contemplated.

The gel composition described herein may be combined with an aerosol-generating device to provide a nicotine aerosol to the lungs at inhalation or air flow rates that are within conventional smoking regime inhalation or air flow rates. The aerosol-generating device may continuously heat the gel composition. A consumer may take a plurality of inhalations or "puffs" where each "puff" delivers an amount of nicotine aerosol. The gel composition may be capable of delivering a high nicotine/low total particulate matter (TPM) aerosol to a consumer when heated, preferably in a continuous manner.

The phrase "stable gel phase" or "stable gel" refers to gel that substantially maintains its shape and mass when exposed to a variety of environmental conditions. The stable gel may not substantially release (sweat) or absorb water when exposed to a standard temperature and pressure while varying relative humidity from about 10 percent to about 60 percent. For example, the stable gel may substantially maintain its shape and mass when exposed to a standard temperature and pressure while varying relative humidity from about 10 percent to about 60 percent.

The gel composition includes an alkaloid compound, or a cannabinoid compound, or both an alkaloid compound and a cannabinoid compound. The gel composition may include one or more alkaloids. The gel composition may include one or more cannabinoids. The gel composition may include a combination of one or more alkaloids and one or more cannabinoids.

The term "alkaloid compound" refers to any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In this disclosure, the term "alkaloid compound" refers to both naturally derived alkaloid compounds and synthetically manufactured alkaloid compounds.

The gel composition may preferably include an alkaloid compound selected from the group consisting of nicotine, anatabine, and combinations thereof.

Preferably the gel composition includes nicotine.

The term "nicotine" refers to nicotine and nicotine derivatives such as free-base nicotine, nicotine salts and the like.

The term "cannabinoid compound" refers to any one of a class of naturally occurring compounds that are found in parts of the Cannabis plant—namely the species Cannabis sativa, Cannabis indica, and Cannabis ruderalis. Cannabinoid compounds are especially concentrated in the female flower heads. Cannabinoid compounds naturally occurring in the Cannabis plant include cannabidiol (CBD) and tetrahydrocannabinol (THC). In this disclosure, the term "cannabinoid compounds" is used to describe both naturally derived cannabinoid compounds and synthetically manufactured cannabinoid compounds.

The gel may include a cannabinoid compound selected from the group consisting of cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabielsoin (CBE),cannabicitran (CBT), and combinations thereof.

The gel composition may preferably include a cannabinoid compound selected from the group consisting of cannabidiol (CBD), THC (tetrahydrocannabinol) and combinations thereof.

The gel may preferably include cannabidiol (CBD).

The gel composition may include nicotine and cannabidiol (CBD).

The gel composition may include nicotine, cannabidiol (CBD), and THC (tetrahydrocannabinol).

The gel composition preferably includes an aerosol-former. Ideally the aerosol-former is substantially resistant to thermal degradation at the operating temperature of the associated aerosol-generating device. Suitable aerosol-formers include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Polyhydric alcohols or mixtures thereof, may be one or more of triethylene glycol, 1,3-butanediol and, glycerine (glycerol or propane-1,2,3-triol) or polyethylene glycol. The aerosol-former is preferably glycerol.

Preferably, in embodiments in which the rod of aerosol-forming substrate comprises a gel composition, as described above, the downstream section of the aerosol-generating article comprises an aerosol-cooling element having a length of less than about 10 millimetres. The use of a relatively short aerosol-cooling element in combination with a gel composition has found to optimise the delivery of aerosol to the consumer.

Embodiments of the invention in which the rod of aerosol-forming substrate comprises a gel composition, as described above, preferably comprise an upstream element (or upstream section) upstream of the rod of aerosol-forming substrate. In this case, the upstream element or section advantageously prevents physical contact with the gel composition. The upstream element or section can also advantageously compensate for any potential reduction in RTD, for example, due to evaporation of the gel composition upon heating of the rod of aerosol-forming substrate during use.

The sheets or webs of homogenised tobacco material may comprise an aerosol former. As used herein, the term "aerosol former" describes any suitable known compound or mixture of compounds that, in use, facilitates formation of an aerosol and that is substantially resistant to thermal degradation at the operating temperature of the aerosol-generating article.

Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Preferred aerosol formers are polyhydric alcohols or mixtures thereof, such as propylene glycol, triethylene glycol, 1,3-butanediol and, most preferred, glycerine.

The sheets or webs of homogenised tobacco material may comprise a single aerosol former. Alternatively, the sheets or webs of homogenised tobacco material may comprise a combination of two or more aerosol formers.

The sheets or webs of homogenised tobacco material have an aerosol former content of greater than 10 percent on a dry weight basis. Preferably, the sheets or webs of homogenised tobacco material have an aerosol former content of greater than 12 percent on a dry weight basis. More preferably, the sheets or webs of homogenised tobacco material have an aerosol former content of greater than 14 percent on a dry weight basis. Even more preferably the sheets or webs of homogenised tobacco material have an aerosol former content of greater than 16 percent on a dry weight basis.

The sheets of homogenised tobacco material may have an aerosol former content of between approximately 10 percent and approximately 30 percent on a dry weight basis. Preferably, the sheets or webs of homogenised tobacco material have an aerosol former content of less than 25 percent on a dry weight basis.

In a preferred embodiment, the sheets of homogenised tobacco material have an aerosol former content of approximately 20 percent on a dry weight basis.

Sheets or webs of homogenised tobacco for use in the aerosol-generating article of the present invention may be made by methods known in the art, for example the methods disclosed in International patent application WO-A-2012/164009 A2. In a preferred embodiment, sheets of homogenised tobacco material for use in the aerosol-generating article are formed from a slurry comprising particulate tobacco, guar gum, cellulose fibres and glycerine by a casting process.

Alternative arrangements of homogenised tobacco material in a rod for use in an aerosol-generating article will be known to the skilled person and may include a plurality of stacked sheets of homogenised tobacco material, a plurality of elongate tubular elements formed by winding strips of homogenised tobacco material about their longitudinal axes, etc.

As a further alternative, the rod of aerosol-forming substrate may comprise a non-tobacco-based, nicotine-bearing material, such as a sheet of sorbent non-tobacco material loaded with nicotine (for example, in the form of a nicotine salt) and an aerosol-former. Examples of such rods are described in the international application WO-A-2015/082652. In addition, or as an alternative, the rod of aerosol-forming substrate may comprise a non-tobacco plant material, such as an aromatic non-tobacco plant material.

The aerosol-forming substrate is circumscribed by a wrapper. The wrapper may be formed of a porous or non-porous sheet material. The wrapper may be formed of any suitable material or combination of materials. Preferably, the wrapper is a paper wrapper.

The mouthpiece segment comprises a plug of filtration material capable of removing particulate components, gaseous components or a combination. Suitable filtration materials are known in the art and include, but are not limited to: fibrous filtration materials such as, for example, cellulose acetate tow, viscose fibres, polyhydroxyalkanoates (PHA) fibres, polylactic acid (PLA) fibres and paper; adsorbents such as, for example, activated alumina, zeolites, molecular sieves and silica gel; and combinations thereof. In addition, the plug of filtration material may further comprise one or more aerosol-modifying agent. Suitable aerosol-modifying agents are known in the art and include, but are not limited to, flavourants such as, for example, menthol. In some embodiments, the mouthpiece segment may further comprise a mouth end recess downstream of the plug of filtration material. By way of example, the mouthpiece segment may comprise a hollow tube arranged in longitudinal alignment with, and immediately downstream of the plug of filtration material, the hollow tube forming a cavity at the mouth end that is open to the outer environment at the downstream end of the mouthpiece segment and of the aerosol-generating article.

A length of the mouthpiece segment is preferably at least about 4 millimetres, more preferably at least about 6 millimetres, even more preferably at least about 8 millimetres. In addition, or as an alternative, a length of the mouthpiece segment is preferably less than 25 millimetres, more preferably less than 20 millimetres, even more preferably less than 15 millimetres. In some preferred embodiments, a length of the mouthpiece segment is from about 4 millimetres to about 25 millimetres, more preferably from about 6 millimetres to about 20 millimetres. The length of the mouthpiece segment may be about 7 millimetres. The length of the mouthpiece segment may be about 12 millimetres.

A length of the hollow tubular segment is preferably at least about 10 millimetres. More preferably, a length of the hollow tubular segment is at least about 15 millimetres. In addition, or as an alternative, a length of the hollow tubular segment is preferably less than about 30 millimetres. More preferably, a length of the hollow tubular segment is less than about 25 millimetres. Even more preferably, a length of the hollow tubular segment is less than about 20 millimetres. In some preferred embodiments, a length of the hollow tubular segment is from about 10 millimetres to about 30 millimetres, more preferably from about 12 millimetres to about 25 millimetres, even more preferably from about 15 millimetres to about 20 millimetres. By way of example, in a particularly preferred embodiment the length of the hollow tubular segment is about 18 millimetres. In another particularly preferred embodiment the length of the hollow tubular segment is about 13 millimetres.

A length of the aerosol-cooling element is preferably at least about 10 millimetres. More preferably, a length of the aerosol-cooling element is at least about 15 millimetres. In addition, or as an alternative, a length of the aerosol-cooling element is preferably less than about 30 millimetres. More preferably, a length of the aerosol-cooling element is less than about 25 millimetres. Even more preferably, a length of the aerosol-cooling element is less than about 20 millimetres. In some preferred embodiments, a length of the aerosol-cooling element is from about 10 millimetres to about 30 millimetres, more preferably from about 12 millimetres to about 25 millimetres, even more preferably from about 15 millimetres to about 20 millimetres. By way of example, in a particularly preferred embodiment the length of the aerosol-cooling element is about 18 millimetres. In another particularly preferred embodiment the length of the aerosol-cooling element is about 13 millimetres.

An overall length of an aerosol-generating article in accordance with the invention is preferably at least about 40 millimetres. In addition, or as an alternative, an overall length of the aerosol-generating article in accordance with the invention is preferably less than about 70 millimetres, more preferably less than 60 millimetres, even more preferably less than 50 millimetres. In preferred embodiments, an overall length of the aerosol-generating article is from about 40 millimetres to about 70 millimetres. In an exemplary embodiment, an overall length of the aerosol-generating article is about 45 millimetres.

The support element (or support segment) may have a length of between about 5 millimetres and about 15 millimetres. In a preferred embodiment, the support element has a length of about 8 millimetres.

The aerosol-generating article preferably has an overall RTD of less than about 90 millimetres H2O (about 900 Pa). More preferably, the aerosol-generating article has an overall RTD of less than about 80 millimetres H2O (about 800 Pa). Even more preferably, the aerosol-generating article has an overall RTD of less than about 70 millimetres H2O (about 700 Pa).

In addition, or as an alternative, the aerosol-generating article preferably has an overall RTD of at least about 30 millimetres H2O (about 300 Pa). More preferably the aerosol-generating article has an overall RTD of at least about 40 millimetres H2O (about 400 Pa). Even more preferably, the aerosol-generating article has an overall RTD of at least about 50 millimetres H2O (about 500 Pa).

The RTD of the aerosol-generating article may be assessed as the negative pressure that has to be applied, under test conditions as defined in ISO 3402, to downstream end of the mouthpiece in order to sustain a steady volumetric flow of air of 17.5 ml/s through the mouthpiece. The values of RTD listed above are intended to be measured on the aerosol-generating article on its own (that is, prior to inserting the article into an aerosol-generating device) without blocking the perforations of the ventilation zone.

As used in the present specification, the term "homogenised tobacco material" encompasses any tobacco material formed by the agglomeration of particles of tobacco material. Sheets or webs of homogenised tobacco material are formed by agglomerating particulate tobacco obtained by grinding or otherwise powdering of one or both of tobacco leaf lamina and tobacco leaf stems. In addition, homogenised tobacco material may comprise a minor quantity of one or more of tobacco dust, tobacco fines, and other particulate tobacco by-products formed during the treating, handling and shipping of tobacco. The sheets of homogenised tobacco material may be produced by casting, extrusion, paper making processes or other any other suitable processes known in the art.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate.

The aerosol-generating device may comprise an extractor for extracting the aerosol-generating article received in the aerosol-generating device, the extractor being configured to be moveable within the device cavity.

The extractor may be configured to expose the air-flow channel when the extractor is in an operating position, the operating position being defined by the heater being in contact with the aerosol-forming substrate of the aerosol-generating article.

The extractor comprises a receptacle body configured to receive an aerosol-generating article. The receptacle body of the extractor (the extractor body) may comprise an end-wall and a peripheral wall. The receptacle body of the extractor comprises an open end, opposite the end-wall, through which an aerosol-generating article can be received. The aerosol-generating article is configured to abut the end-wall once received within the extractor body. The peripheral wall of the receptacle body may circumscribe the aerosol-generating article when received within the extractor. In such embodiments where an extractor is present, the peripheral wall of the extractor body may define the air-flow channel. Alternatively, the peripheral wall of the device housing may define the air-flow channel.

The extractor may be sized such that, in the operating position, the receptacle body extends between a first end of the air-flow channel and the distal end of the device cavity. This enables the aerosol-generating article to be directly exposed to the air-flow channel without having the extractor body obscuring fluid communication between the air-flow channel and the aerosol-generating article.

The extractor may be sized such that, in the operating position, the receptacle body extends between the mouth end of the device cavity and the distal end of the device cavity. In such embodiments, the extractor body may have a cut-out, or a plurality of cut-outs, to allow exposure of the air-flow channel to the aerosol-generating article when inserted. The extractor body and the device cavity together may be configured to ensure alignment during use of said cut-out, or plurality of cut-outs, with the air-flow channel, or the plurality of air-flow channel. For example, the extractor body may comprise a projection arranged to cooperate with a slot or groove located in the housing of the aerosol-generating device.

The aerosol-generating device may comprise an elongate heater arranged for insertion into an aerosol-generating article when an aerosol-generating article is received within the device cavity. The elongate heater may be arranged with the device cavity. The elongate heater may extend into the device cavity. Alternative heating arrangements are discussed further below. However, in such embodiments where the heater extends into the device cavity, the extractor body comprises an aperture at an end-wall for allowing the heater to extend into the aerosol-generating article. Such an aperture may allow air to enter the interior of the extractor cavity, so that air may flow through the rod of aerosol-forming substrate of the aerosol-generating article during use. Alternatively, further apertures may be provided in order to allow air to enter the interior of the extractor cavity.

In some embodiments, the length of the extractor body may be less than the length of the device cavity. In such embodiments, when the extractor is in the operating position (when the extractor is in abutment with the distal end of the device cavity), the air-flow channel may be defined by the portion of the peripheral wall of the device housing not circumscribing the extractor. Such a portion of the peripheral wall may define the air-flow channel when the extractor is in the operating position. Effectively, said portion of the peripheral wall of the device housing may extend longitudinally past the extractor to define an air-flow channel. The spacing or gap between the aerosol-generating article and the peripheral wall of the device housing defines the air-flow channel.

In embodiments where there is an extractor provided, an air-flow channel may be defined between the peripheral wall of the aerosol-generating device housing and an external surface of the extractor. Alternatively, an air-flow channel may be defined within the extractor body. The air-flow channel may be defined in the peripheral wall of the extractor body. The air-flow channel may be defined within the thickness of the peripheral wall of the extractor body. The air-flow channel may extend along the length of the extractor body. The air-flow channel may extend from a longitudinal position away from the end-wall of the extractor body to a longitudinal position near, or at, the open end of the extractor body.

In embodiments where there is no extractor provided, an air-flow channel may be defined within the thickness of the peripheral wall of the aerosol-generating device housing.

The heater may comprise an elongate heating element configured to penetrate the rod of aerosol-forming substrate when the aerosol-generating article is received within the aerosol-generating device.

The heater may be any suitable type of heater. The heater may internally heat the aerosol-generating article. Alternatively, the heater may externally heat the aerosol-generating article. Such an external heater may circumscribe the aerosol-generating article when inserted in or received within the aerosol-generating device.

In some embodiments, the heater is arranged to heat the outer surface of the aerosol-forming substrate. In some embodiments, the heater is arranged for insertion into an aerosol-forming substrate when the aerosol-forming substrate is received within the cavity. The heater may be positioned within the cavity. The heater may extend into the cavity. The heater may be an elongate heater. The elongate heater may be blade-shaped. The elongate heater may be pin-shaped. The elongate heater may be cone-shaped. In some embodiments, the aerosol-generating device comprises an elongate heater arranged for insertion into an aerosol-generating article when an aerosol-generating article is received within the cavity.

The heater may comprise at least one heating element. The at least one heating element may be any suitable type of heating element. In some embodiments, the device comprises only one heating element. In some embodiments, the device comprises a plurality of heating elements. The heater may comprise at least one resistive heating element. Preferably, the heater comprises a plurality of resistive heating elements. Preferably, the resistive heating elements are electrically connected in a parallel arrangement. Advantageously, providing a plurality of resistive heating elements electrically connected in a parallel arrangement may facilitate the delivery of a desired electrical power to the heater while reducing or minimising the voltage required to provide the desired electrical power. Advantageously, reducing or minimising the voltage required to operate the heater may facilitate reducing or minimising the physical size of the power supply.

Suitable materials for forming the at least one resistive heating element include but are not limited to: semiconductors such as doped ceramics, electrically 'conductive' ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys.

In some embodiments, the at least one resistive heating element comprises one or more stamped portions of electrically resistive material, such as stainless steel. Alternatively, the at least one resistive heating element may comprise a heating wire or filament, for example a Ni—Cr (Nickel-Chromium), platinum, tungsten or alloy wire.

In some embodiments, the at least one heating element comprises an electrically insulating substrate, wherein the at least one resistive heating element is provided on the electrically insulating substrate.

The electrically insulating substrate may comprise any suitable material. For example, the electrically insulating substrate may comprise one or more of: paper, glass, ceramic, anodized metal, coated metal, and Polyimide. The ceramic may comprise mica, Alumina ($Al_2O_3$) or Zirconia ($ZrO_2$). Preferably, the electrically insulating substrate has a thermal conductivity of less than or equal to about 40 Watts per metre Kelvin, preferably less than or equal to about 20 Watts per metre Kelvin and ideally less than or equal to about 2 Watts per metre Kelvin.

The heater may comprise a heating element comprising a rigid electrically insulating substrate with one or more electrically conductive tracks or wire disposed on its surface. The size and shape of the electrically insulating substrate may allow it to be inserted directly into an aerosol-forming substrate. If the electrically insulating substrate is not sufficiently rigid, the heating element may comprise a further reinforcement means. A current may be passed through the one or more electrically conductive tracks to heat the heating element and the aerosol-forming substrate.

In some embodiments, the heater comprises an inductive heating arrangement. The inductive heating arrangement may comprise an inductor coil and a power supply configured to provide high frequency oscillating current to the inductor coil. As used herein, a high frequency oscillating current means an oscillating current having a frequency of between 500 kHz and 30 MHz. The heater may advantageously comprise a DC/AC inverter for converting a DC current supplied by a DC power supply to the alternating current. The inductor coil may be arranged to generate a high frequency oscillating electromagnetic field on receiving a high frequency oscillating current from the power supply. The inductor coil may be arranged to generate a high frequency oscillating electromagnetic field in the device cavity. In some embodiments, the inductor coil may substantially circumscribe the device cavity. The inductor coil may extend at least partially along the length of the device cavity.

The heater may comprise an inductive heating element. The inductive heating element may be a susceptor element. As used herein, the term 'susceptor element' refers to an element comprising a material that is capable of converting electromagnetic energy into heat. When a susceptor element is located in an alternating electromagnetic field, the susceptor is heated. Heating of the susceptor element may be the result of at least one of hysteresis losses and eddy currents induced in the susceptor, depending on the electrical and magnetic properties of the susceptor material.

A susceptor element may be arranged such that, when the aerosol-generating article is received in the cavity of the aerosol-generating device, the oscillating electromagnetic field generated by the inductor coil induces a current in the susceptor element, causing the susceptor element to heat up. In these embodiments, the aerosol-generating device is preferably capable of generating a fluctuating electromagnetic field having a magnetic field strength (H-field strength) of between 1 and 5 kilo amperes per metre (kA m), preferably between 2 and 3 kA/m, for example about 2.5 kA/m. The electrically-operated aerosol-generating device is preferably capable of generating a fluctuating electromagnetic field having a frequency of between 1 and 30 MHz, for example between 1 and 10 MHz, for example between 5 and 7 MHz.

In some embodiments, a susceptor element is located in the aerosol-generating article. In these embodiments, the susceptor element is preferably located in contact with the aerosol-forming substrate. The susceptor element may be located in the aerosol-forming substrate.

In some embodiments, a susceptor element is located in the aerosol-generating device. In these embodiments, the susceptor element may be located in the cavity. The aerosol-generating device may comprise only one susceptor element. The aerosol-generating device may comprise a plurality of susceptor elements.

In some embodiments, the susceptor element is arranged to heat the outer surface of the aerosol-forming substrate. In some embodiments, the susceptor element is arranged for insertion into an aerosol-forming substrate when the aerosol-forming substrate is received within the cavity.

The susceptor element may comprise any suitable material. The susceptor element may be formed from any material that can be inductively heated to a temperature sufficient to release volatile compounds from the aerosol-forming substrate. Suitable materials for the elongate susceptor element include graphite, molybdenum, silicon carbide, stainless steels, niobium, aluminium, nickel, nickel containing compounds, titanium, and composites of metallic materials. Some susceptor elements comprise a metal or carbon. Advantageously the susceptor element may comprise or consist of a ferromagnetic material, for example, ferritic iron, a ferromagnetic alloy, such as ferromagnetic steel or stainless steel, ferromagnetic particles, and ferrite. A suitable susceptor element may be, or comprise, aluminium. The susceptor element preferably comprises more than about 5 percent, preferably more than about 20 percent, more preferably more than about 50 percent or more than about 90 percent of ferromagnetic or paramagnetic materials. Some elongate susceptor elements may be heated to a temperature in excess of about 250 degrees Celsius.

The susceptor element may comprise a non-metallic core with a metal layer disposed on the non-metallic core. For example, the susceptor element may comprise metallic tracks formed on an outer surface of a ceramic core or substrate.

In some embodiments the aerosol-generating device may comprise at least one resistive heating element and at least one inductive heating element. In some embodiments the aerosol-generating device may comprise a combination of resistive heating elements and inductive heating elements.

The aerosol-generating device may comprise a power supply. The power supply may be a DC power supply. In some embodiments, the power supply is a battery. The power supply may be a nickel-metal hydride battery, a nickel cadmium battery, or a lithium based battery, for example a lithium-cobalt, a lithium-iron-phosphate or a lithium-polymer battery. However, in some embodiments the power supply may be another form of charge storage device, such as a capacitor. The power supply may require recharging and may have a capacity that allows for the storage of enough energy for one or more user operations, for example one or more aerosol-generating experiences. For example, the power supply may have sufficient capacity to allow for continuous heating of an aerosol-forming substrate for a period of around six minutes, corresponding to the typical time taken to smoke a conventional cigarette, or for a period that is a multiple of six minutes. In another example, the power supply may have sufficient capacity to allow for a predetermined number of puffs or discrete activations of the heater.

Specific embodiments will now be described with reference to the figures, in which.

Figure 1:
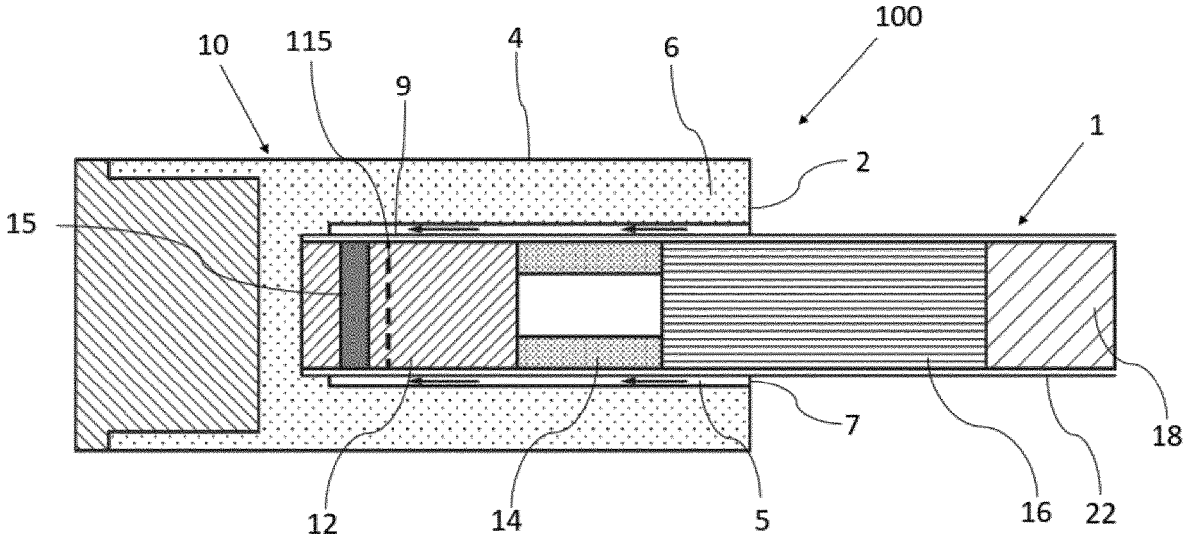
FIG. 1 is a schematic cross-sectional diagram of an embodiment of an aerosol-generating system in accordance with the present disclosure.

FIG. 1 illustrates an aerosol-generating system 100 comprising an aerosol-generating device 10 and an aerosol-generating article 1. The aerosol-generating device 10 comprises a housing 4, extending between a mouth end 2 and a distal end (not shown). The housing 4 comprises a peripheral wall 6. The peripheral wall 6 defines a device cavity for receiving an aerosol-generating article 1. The device cavity is defined by a closed, distal end and an open, mouth end. The mouth end of the device cavity is located at the mouth end of the aerosol-generating device 10. The aerosol-generating article 1 is configured to be received through the mouth end of the device cavity and is configured to abut the closed end of the device cavity. The length of the device cavity is about 25 mm.

An air-flow channel 5 is defined within the peripheral wall 6. The air-flow channel 5 extends between an inlet 7 located at the mouth end of the aerosol-generating device 10 and outlet 9 located at a distal position along the peripheral wall 6.

The aerosol-generating device 10 further comprises a heater (not shown) and a power source (not shown) for supplying power to the heater. A controller (not shown) is also provided to control such supply of power to the heater. The heater is configured to heat the aerosol-generating article 1 during use, when the aerosol-generating article 1 is received within the device 10.

The aerosol-generating article 1 comprises a first air ingress zone 15 and a second air ingress zone 115 located along the wrapper 22. The first air ingress zone 15 comprises a porous portion of the wrapper 22. Such a porous portion forming the first air ingress zone 15 is about 3 mm wide. The first and second air ingress zones 15, 115 are separated by a distance of about 1.5 mm.

Figure 2:
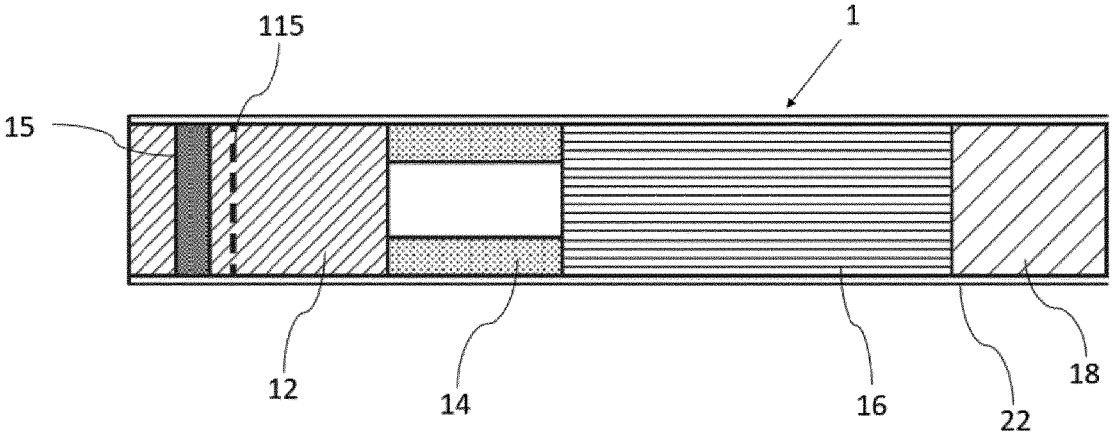
FIG. 2 is a schematic cross-sectional diagram of an embodiment of an aerosol-generating article in accordance with the present invention.

The second air ingress zone 115, as shown in FIGS. 1 and 2, comprises a line of perforations extending through the wrapper 22. The second air ingress zone 115 is located about 1.5 mm downstream of the first air ingress zone 15. Both the first and second air ingress zones 15, 115 are located along the rod of aerosol-forming substrate 12. The first air ingress zone 15 is located about 2 mm downstream of the upstream end of the rod of aerosol-forming substrate 12.

When the aerosol-generating article 1 is received within the device cavity, the outlet 9 is configured to align or overlie the first air ingress zone 15. Once received within the device cavity, the upstream end of the aerosol-generating article 1 is arranged to abut the closed end of the device cavity such that air being drawn through the aerosol-generating device 10 may not flow through the upstream end of the aerosol-generating article 1. Air being drawn through the aerosol-generating device 10 may only enter the aerosol-generating article 1 through the first and second air ingress zones 15, 115, as shown in FIG. 1.

The air-flow channel 5 is defined along the inner surface of the peripheral wall 6. In such embodiments, a portion of the air-flow channel 5 is configured to overlie the first and second air ingress zones 15, 115 of the aerosol-generating article 1. The air-flow channel 5 has a length of about 23 millimetres. In such an embodiment, shown in FIG. 1, the entire length of the air-flow channel 5 is configured to overlie the aerosol-generating article 1 when received within the device 10.

FIG. 2 displays the aerosol-generating article 1, which is configured to be used in the aerosol-generating system 100 shown in FIG. 1.

The aerosol-generating article 1 comprises a rod of aerosol-forming substrate 12, a hollow support segment 14, an aerosol-cooling element (or segment) 16 and a mouthpiece segment 18. The components (in this case, the hollow support segment 14, the aerosol-cooling element 16 and the mouthpiece segment 18) downstream of the rod of aerosol-forming substrate 12 form the downstream section of the aerosol-generating article 1. These four elements are arranged in an end-to-end, longitudinal alignment and are circumscribed by a wrapper 22 to form the aerosol-generating article 1. The aerosol-generating article 1 shown in FIG. 1 is particularly suitable for use with an electrically operated aerosol-generating device 1 comprising a heater for heating the rod of aerosol-forming substrate 12.

The rod of aerosol-forming substrate 12 has a length of about 12 millimetres and a diameter of about 7 millimetres. The rod 12 is cylindrical in shape and has a substantially circular cross-section. The rod 12 comprises a gathered sheet of homogenised tobacco material. The hollow cellulose acetate tube (hollow support segment) 14 has a length of about 8 millimetres and its peripheral wall has a thickness of 1 millimetre.

The mouthpiece segment 18 comprises a plug of cellulose acetate tow of 8 denier per filament and has a length of about 7 millimetres. The mouthpiece segment 18 has a diameter of about 7 millimetres. The aerosol-cooling element 16 has a length of about 18 millimetres and a diameter of about 7 millimetres.

The aerosol-generating article 1 comprises a first air ingress zone 15 provided along the rod of aerosol-forming substrate, at least about 2 millimetres from an upstream end of the rod of aerosol-forming substrate 12. The first air ingress zone 15 is located less than 10 millimetres from the downstream end of the rod of aerosol-forming substrate 12, or upstream end of the hollow support segment 14. The first and second air ingress zones 15, 115 circumscribe the aerosol-generating article 1. That is, the first and second air ingress zones 15, 115 surround the entire periphery of the aerosol-generating article 1.

Figure 3:
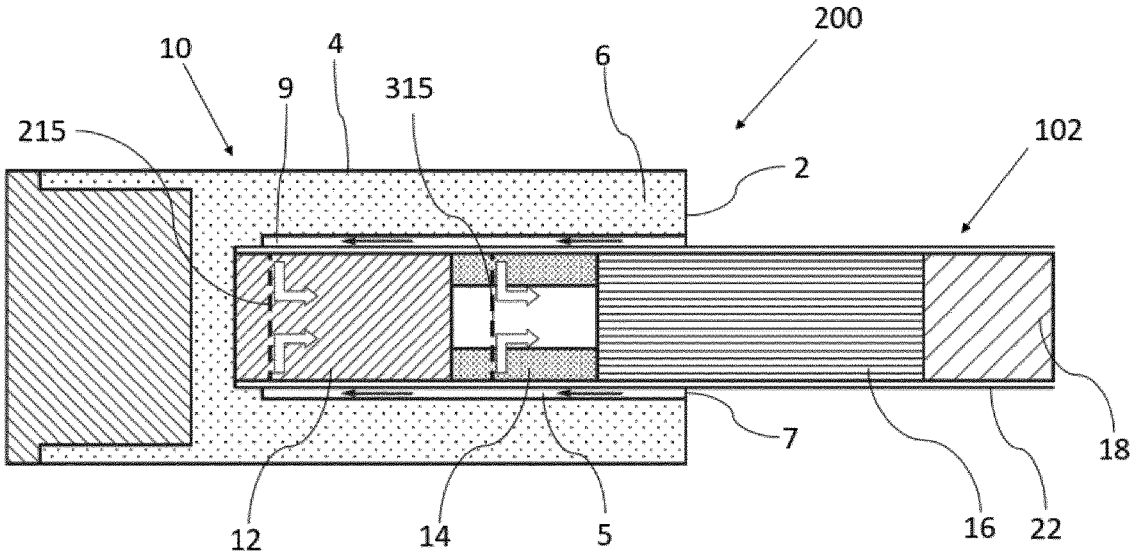
FIG. 3 is a schematic cross-sectional diagram of an embodiment of an aerosol-generating system in accordance with the present disclosure.

FIG. 3 displays an aerosol-generating system 200 similar to the aerosol-generating system 100 shown in FIG. 1. The aerosol-generating system 200 comprises the aerosol-generating device 10 and an aerosol-generating article 102, shown in FIG. 4. The aerosol-generating system 200 differs from aerosol-generating system 100 in that the first air ingress zone 215 is located along the rod of aerosol-forming substrate 12 and the second air ingress zone 315 is located along the hollow support segment 14 of the aerosol-generating article 102, as shown in FIG. 4.

Figure 4:
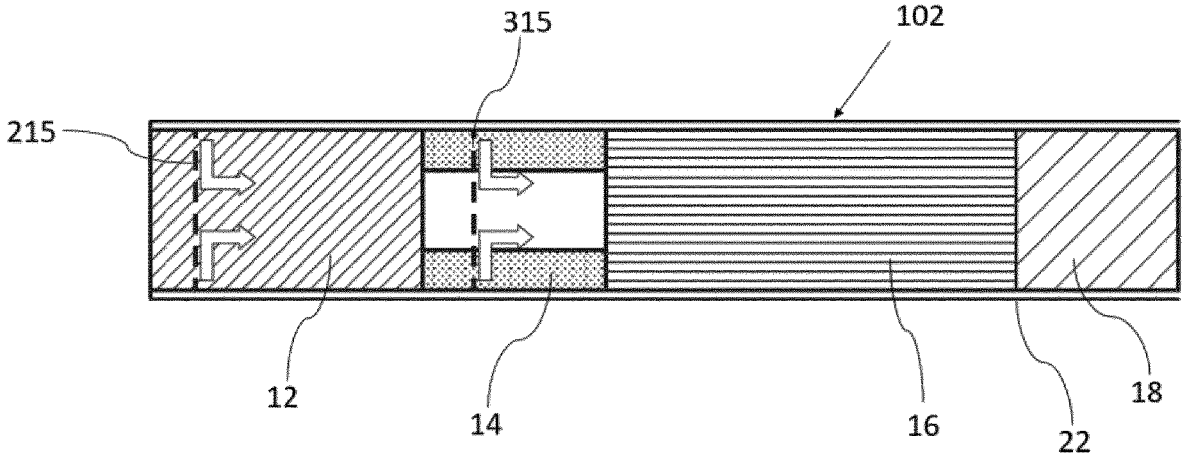
FIG. 4 is a schematic cross-sectional diagram of an embodiment of an aerosol-generating article in accordance with the present invention.

The aerosol-generating article 102, which is configured to be used with aerosol-generating system 200, is illustrated in FIG. 4.

The first air ingress zone 215 is located about 2 mm downstream of the upstream end of the rod of aerosol-forming substrate 12. The second air ingress zone 215 is located about 2 mm downstream of the upstream end of the hollow support segment 14 and about 2 mm downstream of the downstream end of the rod of aerosol-forming substrate 12, given that the rod of aerosol-forming substrate 12 and the hollow support segment 14 are in direct abutment. Thus, the two air ingress zones 215, 315 are located along and around two different components of the aerosol-generating article 102.

In the embodiment of FIG. 3, the first and second air ingress zones 215, 315 each comprise a line of perforations extending around the article 102 and through the wrapper 22. The second air ingress zone 315 extends through the peripheral wall of the hollow support segment 14.

Figure 5:
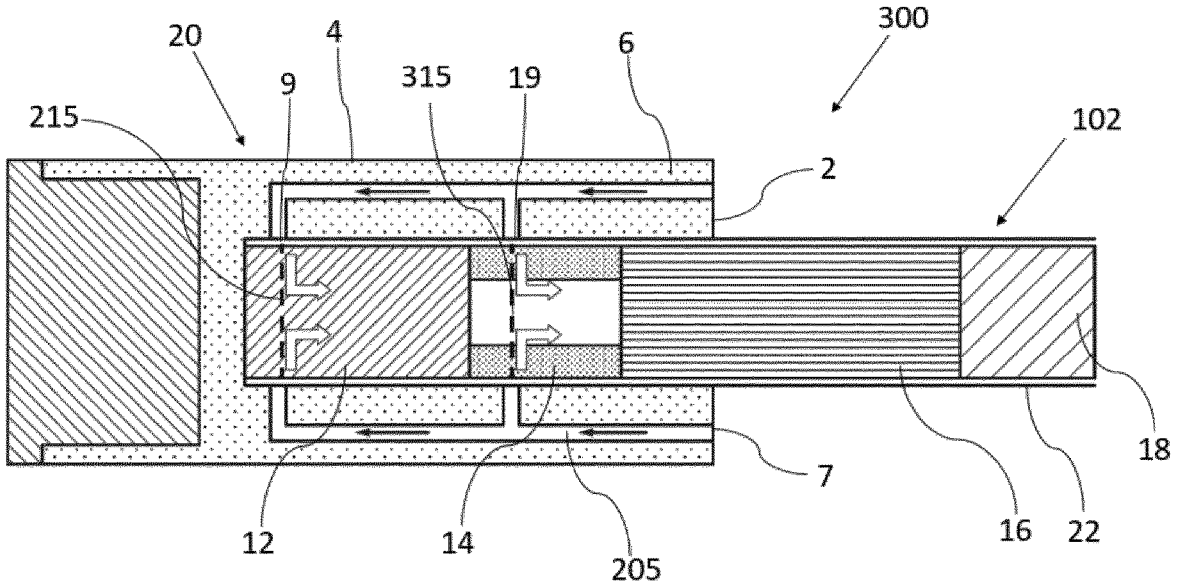
FIG. 5 is a schematic cross-sectional diagram of an embodiment of an aerosol-generating system in accordance with the present disclosure.

FIG. 5 shows an aerosol-generating system 300 similar to aerosol-generating system 200. The aerosol-generating system 300 comprises an aerosol-generating device 20 and the aerosol-generating article 102, both configured to be used with each other. The aerosol-generating device 20 is similar to aerosol-generating device 10, but differs in that the device 20 comprises an air-flow channel 205 comprising one inlet 7 and two outlets 9, 19. A first outlet 9 of the air-flow channel 205 is configured to provide fluid communication between the exterior of the aerosol-generating device 20 and a first air ingress zone 215 of the aerosol-generating article 102. A second outlet 19 of the air-flow channel 205 is configured to provide fluid communication between the exterior of the aerosol-generating device 20 and a second air ingress zone 315 of the aerosol-generating article 102. The first outlet 9 is configured to overlie (or overlap) the first air ingress zone 215 when the article 102 is received within the device 20 and the second outlet 19 is configured to overlie (or overlap) the second air ingress zone 315 when the article 102 is received within the device 20. The spacing or distance between the first and second outlets 9,19 can be equivalent to the distance between the first and second air ingress zones 215, 315.

As shown in FIGS. 1, 3 and 5, fluid communication between the exterior of the aerosol-generating devices 10, 20 and the interior of the aerosol-generating article 1, 102 is established via two different air ingress zones 15, 115 & 215, 315. However, the first air ingress zone 15, 215 is configured to be able to allow the passage of more air than the second air ingress zone 115, 315. In other words, the first air ingress zone 15, 215 is configured to provide a greater level of air ingress than the second air ingress zone 115, 315.

The first air ingress zone 15, 215 is configured to be the primary air intake zone of the aerosol-generating article 1, 102 when the article 1, 102 is received within the device 10, 20 when an abutment of the upstream end of the article 1, 102 with the distal end of the device cavity occurs. The second air ingress zone 115, 315 is configured to provide ventilation to the article 1, 102; that is, ventilating air to aerosol flowing from the rod of aerosol-forming substrate 12 through the hollow support segment 14 towards the mouth end of the article 1, 102.

When received within the aerosol-generating device 10, 20, the open, upstream end of the aerosol-generating article 1, 102 abuts the distal end of the device cavity in order to prevent air flowing through the upstream end of the aerosol-generating article 1, 102. Therefore, during use, most of the air flowing through the air-flow channel 5, 205 is configured to flow through the first air ingress zone 15, 215 due to the overlap between the air-flow channel outlet 9 and the first air ingress zone 15, 215.

Figure 6:
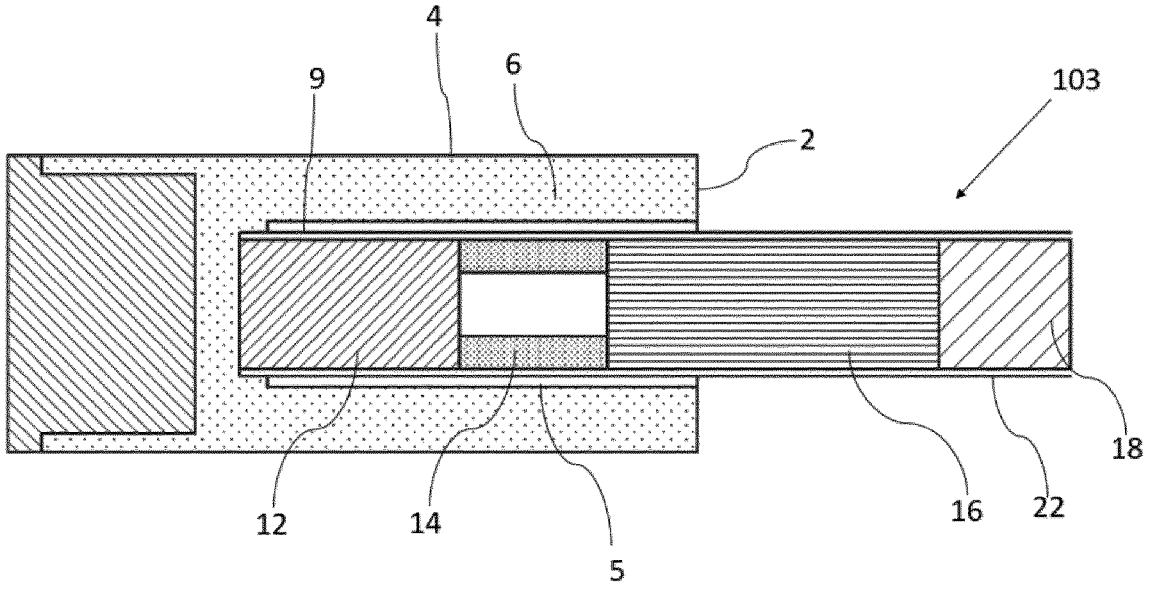
FIG. 6 is a schematic cross-sectional diagram of a comparative example of an aerosol-generating system.

FIG. 6 shows a comparative example of an incompatible aerosol-generating article 103, which does not have a first air ingress zone located around the rod of aerosol-forming substrate, being used with the aerosol-generating device 10. Owing to the fact that the article 103 does not have an air ingress zone and that the upstream end of the article 103 is in abutment with the distal end of the device cavity, air cannot be drawn through the article 103.

The aerosol-generating device 10 comprises an annular air-flow channel 5, as shown in FIGS. 1 & 3. The aerosol-generating device 20, as shown in FIG. 5, comprises at least two air-flow channels 205.

Unless otherwise specified, the described aerosol-generating articles 1, 102 comprise the same structural components—for example, a rod of aerosol-forming substrate 12, a hollow support segment 14, an aerosol-cooling element 16 and a mouthpiece segment 18 arranged within a wrapper 22—but mainly differ in the configuration of the air ingress zones provided on the article.

The invention claimed is:

1. An aerosol-generating article for producing an aerosol upon heating, the aerosol-generating article comprising:

a rod of aerosol-forming substrate;

a filter positioned downstream of the rod of aerosol-forming substrate, wherein the rod of aerosol-forming substrate and the filter are assembled within a wrapper; and first and second air ingress zones located on the wrapper, the first and the second air ingress zones each being configured to allow an ingress of air into an interior of the aerosol-generating article, wherein the first air ingress zone comprises a substantially porous portion of the wrapper, the substantially porous portion having a porosity of at least 3000 Coresta Units, wherein a width of the first air ingress zone is at least 3 mm, and wherein a level of air ingress into the interior of the aerosol-generating article through the first air ingress zone is configured to be greater than a level of air ingress into the interior of the aerosol-generating article through the second air ingress zone.

2. The aerosol-generating article according to claim 1, wherein the second air ingress zone is located downstream of the first air ingress zone.

3. The aerosol-generating article according to claim 1, wherein the first air ingress zone is located along the rod of aerosol-forming substrate and the second air ingress zone is located downstream of the rod of aerosol-forming substrate.

4. The aerosol-generating article according to claim 1, wherein the filter of the aerosol-generating article comprises:

a mouthpiece segment comprising a plug of filtration material arranged downstream of the rod of aerosol-forming substrate, and a hollow tubular segment located between the mouthpiece segment and the rod of aerosol-forming substrate.

5. The aerosol-generating article according to claim 4, wherein the filter of the aerosol-generating article further comprises an aerosol-cooling element located between the mouthpiece segment and the hollow tubular segment.

6. The aerosol-generating article according to claim 4, wherein the second air ingress zone is located along the hollow tubular element.

7. The aerosol-generating article according to claim 1, wherein the first air ingress zone is located at least 2 mm downstream of an upstream end of the rod of aerosol-forming substrate.

8. The aerosol-generating article according to claim 1, wherein the second air ingress zone is located at least 2 mm downstream of a downstream end of the rod of aerosol-forming substrate.

9. The aerosol-generating article according to claim 1, wherein the second air ingress zone is located at least 2 mm downstream of the first air ingress zone.

10. The aerosol-generating article according to claim 1, wherein a first volume of air configured to enter the interior of the aerosol-generating article through the first air ingress zone is at least 10 percent greater than a second volume of air configured to enter the interior of the aerosol-generating article through the second air ingress zone.

11. The aerosol-generating article according to claim 1, wherein the second air ingress zone comprises a substantially porous portion of the wrapper.

12. The aerosol-generating article according to claim 1, wherein the first air ingress zone or the second air ingress zone comprises a plurality of apertures extending through the wrapper.

13. The aerosol-generating article according to claim 1, wherein the first air ingress zone has a porosity of at least 5000 Coresta Units.

14. The aerosol-generating article according to claim 1, wherein the wrapper of the aerosol-generating article comprises an air-impermeable material.

15. The aerosol-generating article according to claim 1, wherein a width of the first air ingress zone is at least 5 mm.

16. The aerosol-generating article according to claim 1, wherein a width of the first air ingress zone is greater than a width of the second air ingress zone.

17. An aerosol-generating system comprising an aerosol-generating article and an aerosol-generating device having a distal end and a mouth end, the aerosol-generating article comprising:

a rod of aerosol-forming substrate, a filter positioned downstream of the rod of aerosol-forming substrate, wherein the rod of aerosol-forming substrate and the filter are assembled within a wrapper, and first and second air ingress zones located on the wrapper, the first and the second air ingress zones each being configured to allow an ingress of air into an interior of the aerosol-generating article, wherein the first air ingress zone comprises a substantially porous portion of the wrapper, the substantially porous portion having a porosity of at least 3000 Coresta Units, wherein a width of the first air ingress zone is at least 3 mm, and wherein a level of air ingress into the interior of the aerosol-generating article through the first air ingress zone is configured to be greater than a level of air ingress into the interior of the aerosol-generating article through the second air ingress zone; and the aerosol-generating system comprising:

a housing defining a device cavity configured to removably receive the aerosol-generating article at the mouth end of the aerosol-generating device;

a heater configured to heat the aerosol-forming substrate when the aerosol-generating article is received within the device cavity; and an air-flow channel extending between a channel inlet and a channel outlet, the air-flow channel being configured to establish a fluid communication between an interior of the device cavity and an exterior of the aerosol-generating device, wherein the aerosol-generating system is configured so that, when the aerosol-generating article is received within the device cavity, fluid communication between the interior of the aerosol-generating article and the exterior of the aerosol-generating device is established by a fluid communication being established between the first air ingress zone of the aerosol-generating article received within the device cavity and the air-flow channel of the aerosol-generating device.

* * * * *